United States Patent [19]

Rubbo et al.

[11] Patent Number: 4,949,793

[45] Date of Patent: Aug. 21, 1990

[54] METHOD AND APPARATUS FOR COMPLETION OF A WELL

[75] Inventors: Richard P. Rubbo, The Woodlands; F. T. Tilton, Spring; A. A. Mullins, Humble; Daniel S. Bangert, Kingwood; Forrest Howard, Houston, all of Tex.; Scott Carpenter, New Orleans, La.; Alfred R. Curington, The Woodlands, Tex.

[73] Assignee: Baker Hughes Incorporated, Houston, Tex.

[21] Appl. No.: 345,347

[22] Filed: Apr. 28, 1989

[51] Int. Cl.[5] ..... E21B 23/00; E21B 33/124; E21B 43/11

[52] U.S. Cl. ..... 166/382; 166/240; 166/387; 166/134

[58] Field of Search ..... 166/120, 122, 123, 125, 166/132, 206, 209, 216, 217, 240, 118, 134, 138, 381, 382, 383, 388; 285/82, 306, 920, 922; 175/4.52

[56] References Cited

U.S. PATENT DOCUMENTS

| | | | |
|---|---|---|---|
| 2,906,347 | 9/1959 | Baker | 166/139 X |
| 4,537,251 | 8/1985 | Braddick | 166/134 X |
| 4,655,298 | 4/1987 | George et al. | 175/4.52 |
| 4,834,175 | 5/1989 | Ross et al. | 166/187 X |

*Primary Examiner*—William P. Neuder

*Attorney, Agent, or Firm*—Hubbard, Thurman, Turner, Tucker

[57] ABSTRACT

An apparatus and method are provided for completion of a horizontal section of a subterranean well. The apparatus comprises a first packer assembly which is settable in the well by longitudinal manipulation of a tubular workstring. A second packer is carried into the well on the workstring and is settable by application of hydraulic pressure through the workstring. A perforating gun is carried into the well on and in communication with the workstring, together with a gun retractor for telescopically retracting the perforating gun. A valve is also provided for selective communication between the exterior and the interior of the apparatus and is manipulatable to the open position to effect, for example, a fluid flow path from the production zone to the top of the well for transmission of production fluids in the well.

7 Claims, 22 Drawing Sheets

METHOD AND APPARATUS FOR COMPLETION OF A WELL

BACKGROUND OF THE INVENTION

1. FIELD OF THE INVENTION

The invention relates to a method and apparatus for completion of a subterranean well.

2. DESCRIPTION OF THE PRIOR ART

Subsequent to the drilling of a subterranean oil or gas well, a string of tubular conduit commonly referred to as "casing" is run into the well. Thereafter, the casing is cemented into place. After the cementing operation, it is necessary to perforate the well so that production fluids within the production zone may flow from the production zone, through holes perforated through the cement behind the casing, into holes in the casing, and through the well bore to the top of the well.

For many years the desirability of utilizing a subterranean wellbore having a non-vertical or horizontal portion traversing a production formation has been known and appreciated in the prior art. Laterally directed bores are drilled radially, usually horizontally from the primary vertical wellbore, in order to increase contact with the production formation.

Most production formations have substantial horizontal portions and, when conventional vertical wellbores are employed to tap such production formations, a large number of vertical bores must be employed. With the drilling of a wellbore having a non-vertical or horizontal portion traversing the production formation, a much greater area of the production formation may be traversed by the wellbore and the total field of drilling costs may be substantially decreased. Additionally, after a particular horizontal wellbore has produced all of the economically available hydrocarbons, the same vertical wellbore may be re-drilled to establish another horizontal portion extending in another direction and thus prolong the utility of the vertical portion of the well and increase the productivity of the well to include the total production formation.

By use of and reference to the phrase "wellbore" herein, it is intended to include both cased and uncased wells. When uncased wells are completed, the bore hole wall defines the maximum hole diameter at a given location. When cased wells are completed, the "wall" of the well will be the internal diameter of the casing conduit.

By use of the phrase "deviated well" and "deviated wellbore", it is meant to refer to wells and wellbores which comprise a vertical entry section communicating through a relatively short radius curvature portion with a non-vertical or horizontal portion communicating with the production formation. In most instances, the production formation extends for a substantial horizontal extent and the generally linear wellbore portion traverses a substantial horizontal extent of the production formation, at least up to a distance of 1000 to 2000 feet, or more. The radius portion of the wellbore has a curvature of at least 10° per 100 feet of length, and preferably a curvature lying in the range of 10° to 30° per 100 feet of length.

The present invention is not limited to use in horizontal completions of deviated wells and can be used in conventional or straight hole subterranean wells. It does have particular utility in horizontal completions wherein it is desired to run into the well a perforating gun and thereafter treat or acidize a well all in one trip of the workstring into and out of the well. When it is desired to perform such operations within a horizontal section of a deviated subterranean well, a completion hookup incorporating a tubing carried perforating gun in combination with a retraction apparatus may be carried into the well on a workstring carrying a retrievable packer and, somewhat below the retrievable packer, a permanent completion packer. Preferably, the permanent completion packer has extending from its lowermost end a cylindrical production string having thereon a sliding sleeve valve mechanism for selectively opening and closing a port communicating to the annular area between the casing and the production string extending from below the permanent packer. The end of the production string is selectively sealingly latchable into a sump packer previously positioned just below the production zone. Through the interior of the production string and the permanent completion packer is carried by means of the retrievable packer a section of smaller concentrically positioned tubing having at its lowermost end the retraction apparatus which, in turn, has affixed to its lowermost end a tubing carried perforating gun.

After activating the perforating gun, it is necessary to telescopically retract same with respect to the production string section extending from the lowermost end of the production packer so that the seal assembly surrounding the lowermost exterior of the production string, or locator mandrel, may be latched into the sump packer. Thereafter, the production packer is set, the retrievable packer is unset and the apparatus is withdrawn from the well. The sliding sleeve is in the closed position, such that the production zone is thereby controllably isolated from the interior of the production string, but may thereafter be opened to communicate the production zone with the interior of the apparatus retained in the well, and thence to the top of the well through a production conduit.

Of course, prior to engaging the seal assembly on the locator mandrel on the lowermost end of the production string into the sump packer, any one of a number of selected treatment procedures may be effected, such as acidizing or fracturing of such zone, and such treatment may be effected prior to setting of the permanent packer and withdrawal of the retrievable packer.

CROSS-REFERENCE TO RELATED APPLICATIONS

The subject matter of this application is related to co-pending Application Ser. No. 345,107, filed Apr. 28, 1989, entitled "Method and Apparatus for Selective Retraction of a Tubing Carried Perforating Gun" Application Ser. No. 345,206, filed Apr. 28, 1989, entitled "Packer Assembly and Means for Activating Same Only in Smaller Diameter Well Conduit" and Application Ser. No. 345,106, filed Apr. 28, 1989, entitled "Hydraulically Actuated Packer Assembly With Dual Piston and Cylinder Arrangement", each of said applications assigned to the assignee of the instant application.

SUMMARY OF THE INVENTION

The present invention provides an apparatus for completion of a subterranean well, comprising a first packer assembly which is settable in the well only by longitudinal manipulation of a tubing workstring. The second packer assembly is settable by application of hydraulic pressure through the workstring. A perforating gun is carried into the well on and in communication with the workstring. Means for telescopically retracting the perforating gun are also provided, together with a locator mandrel carriable in the well on the workstring at the lowermost end of the apparatus with the mandrel having an exterior sealing surface for selective sealing engagement with the seal receptacle assembly positioned in the well below a production zone subsequent to the firing of the perforating gun and retraction of the gun by the means for telescopically retracting the gun. The workstring is longitudinally manipulated to sealingly position the locator mandrel relative to the receptacle assembly to completely isolate the production zone. Actuation at a later time of a valve means within said apparatus will establish fluid flow communication between the exterior and the interior of the apparatus to permit the production fluids to pass therethrough to the top of the well.

DESCRIPTION OF THE PREFERRED EMBODIMENTS

Figure 1:
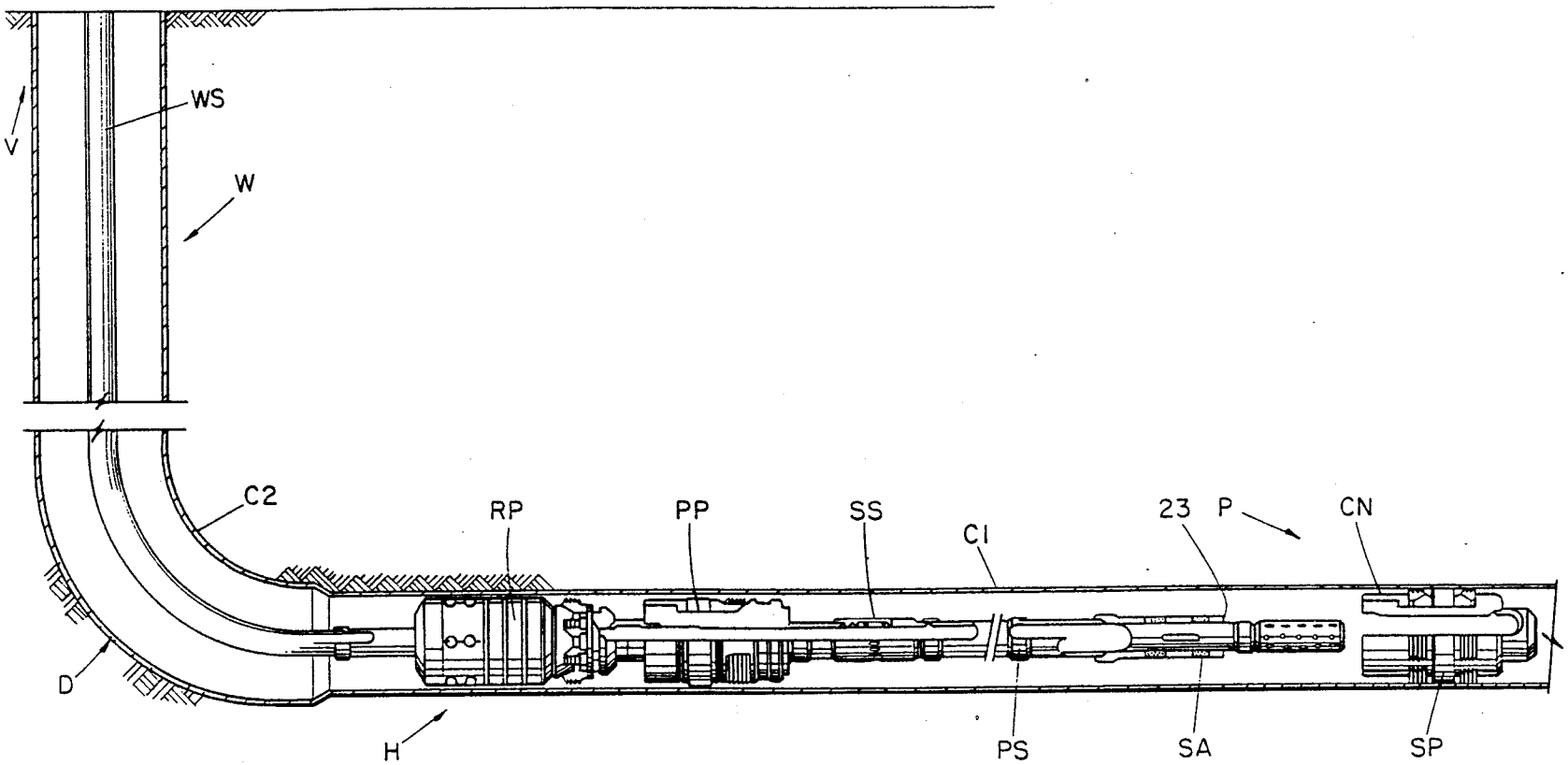
FIG. 1 is a schematic illustration of a subterranean well incorporating the apparatus of the present invention in a workstring in a horizontal section of a deviated well.
Figure 2A:
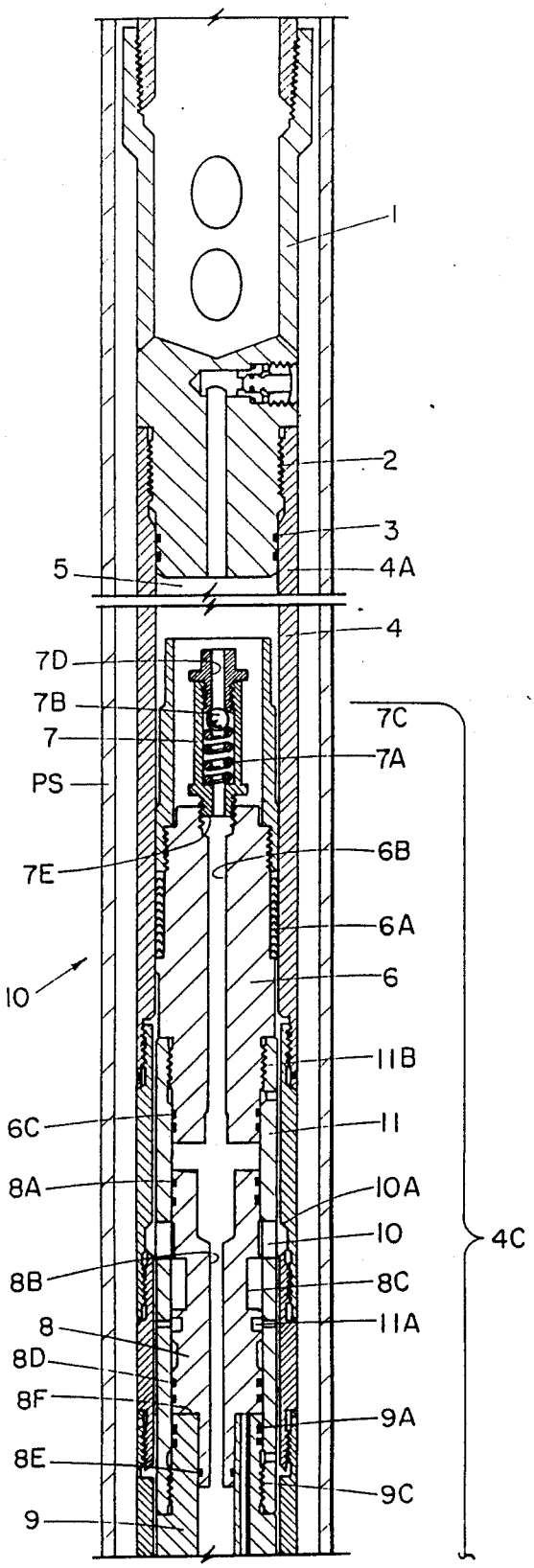
FIGS. 2A through 2D together constitute a longitudinal sectional illustration of the preferred gun retraction means of the present invention with the component parts in expanded position.
Figure 2B:
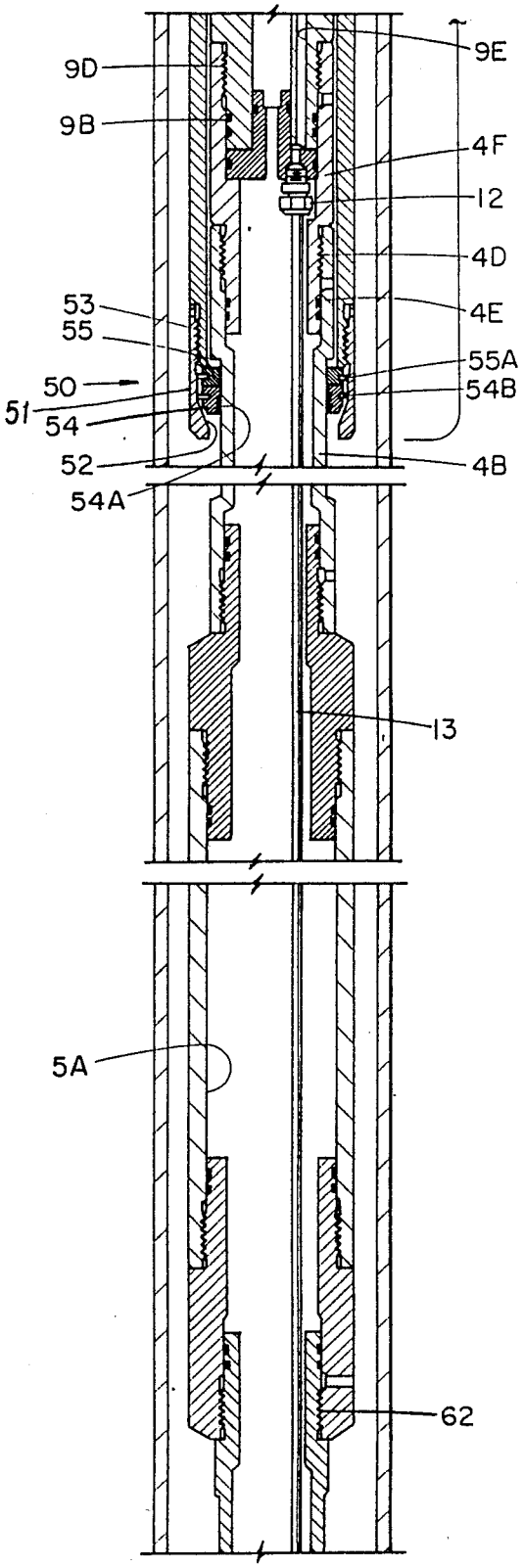
Figure 2C:
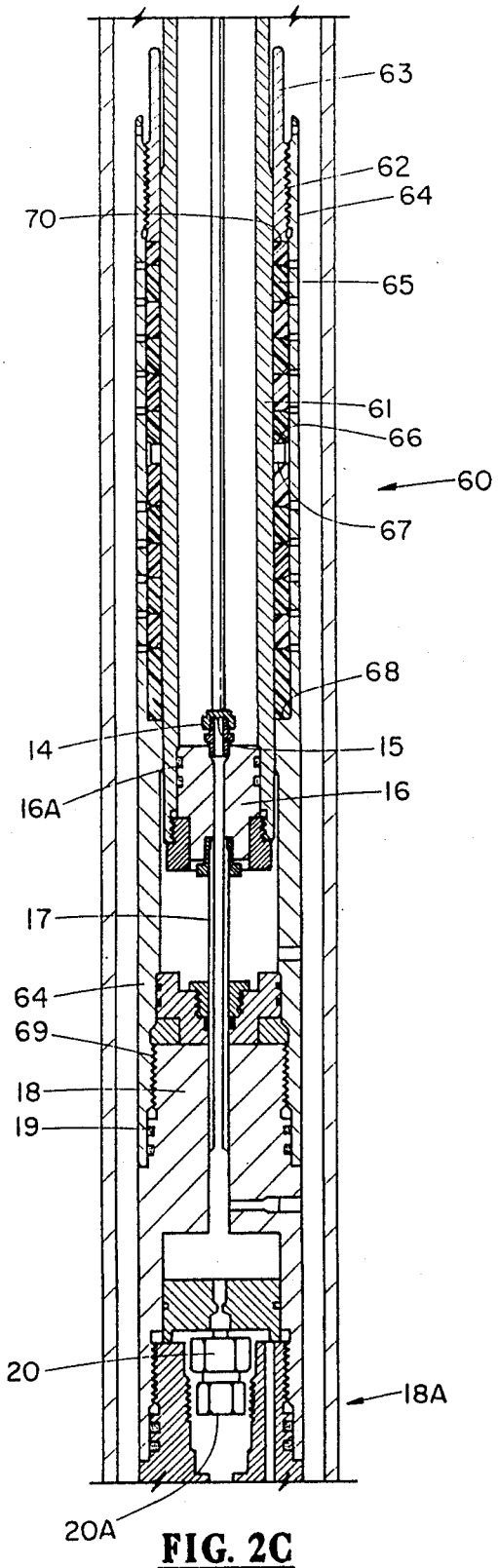
Figure 2D:
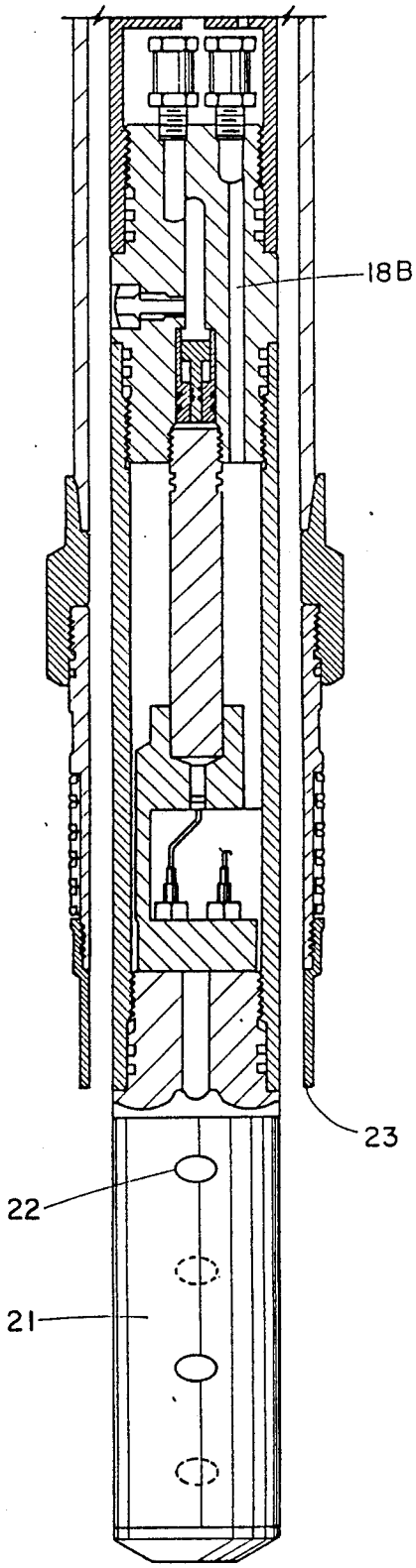
Figure 3A:
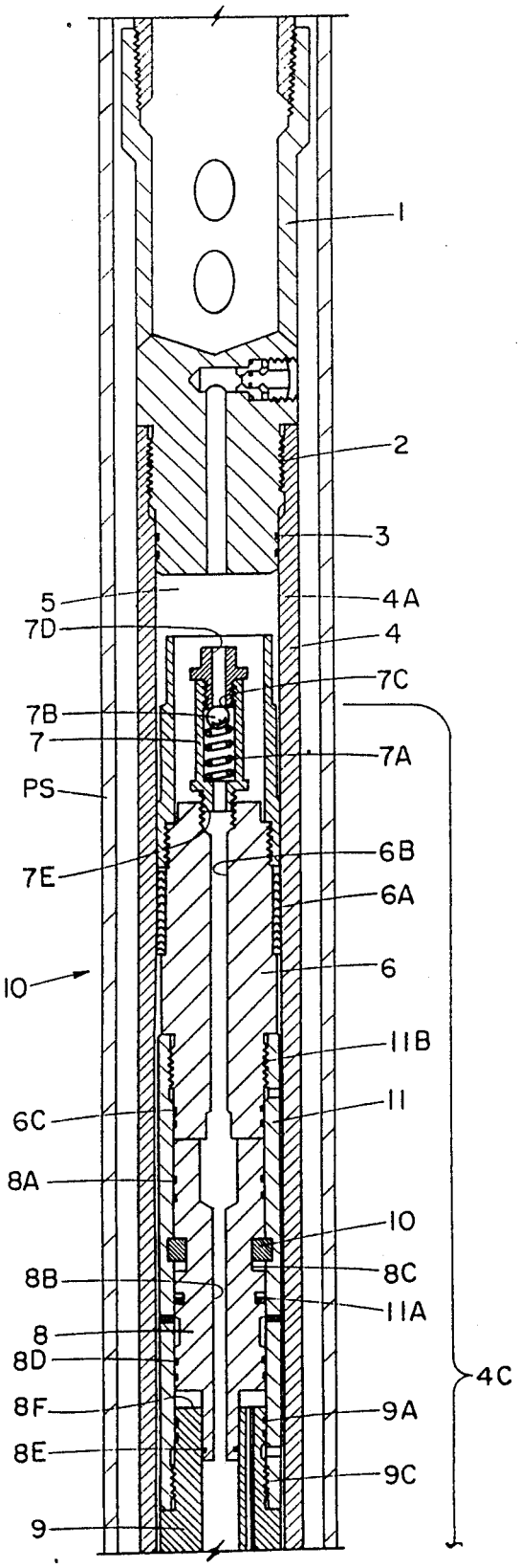
FIGS. 3A through 3D constitute longitudinal sectional illustrations similar to that of FIGS. 2A through 2D showing the gun retraction means of the apparatus in telescopically retracted position subsequent to the firing of the perforating gun.
Figure 3B:
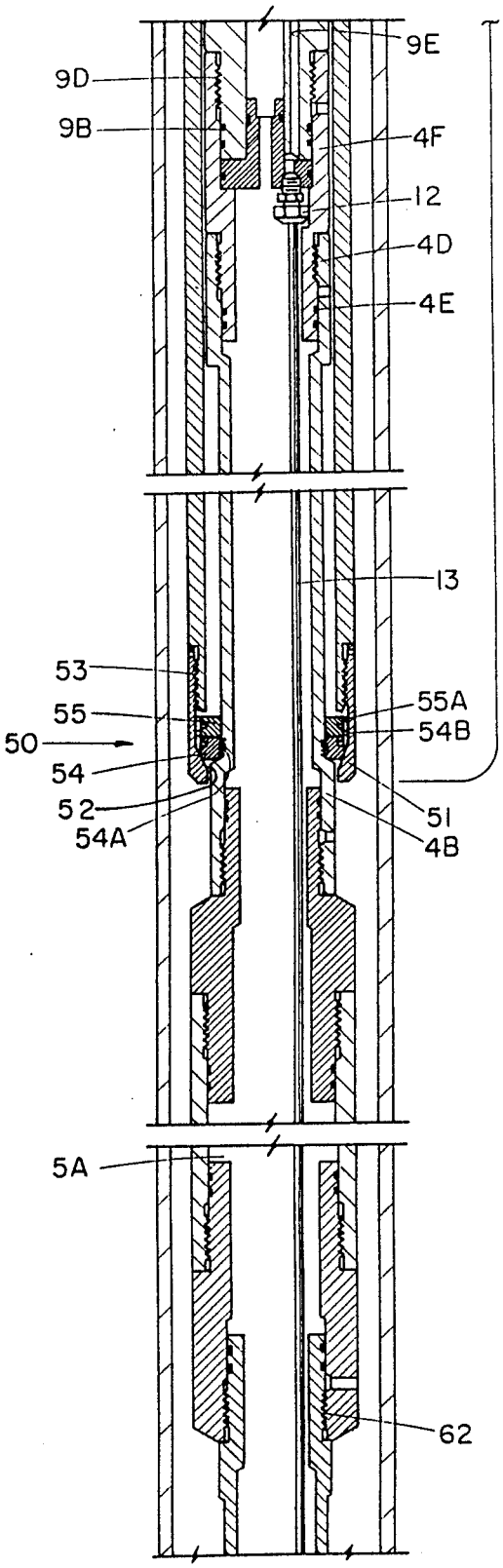
Figure 3C:
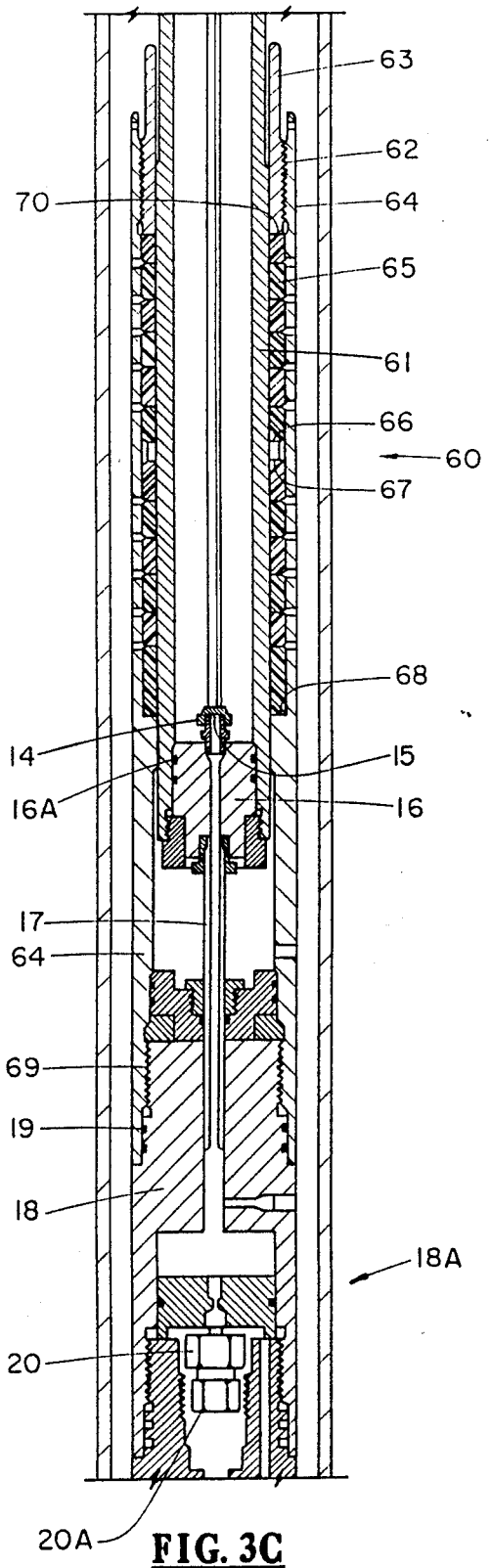
Figure 3D:
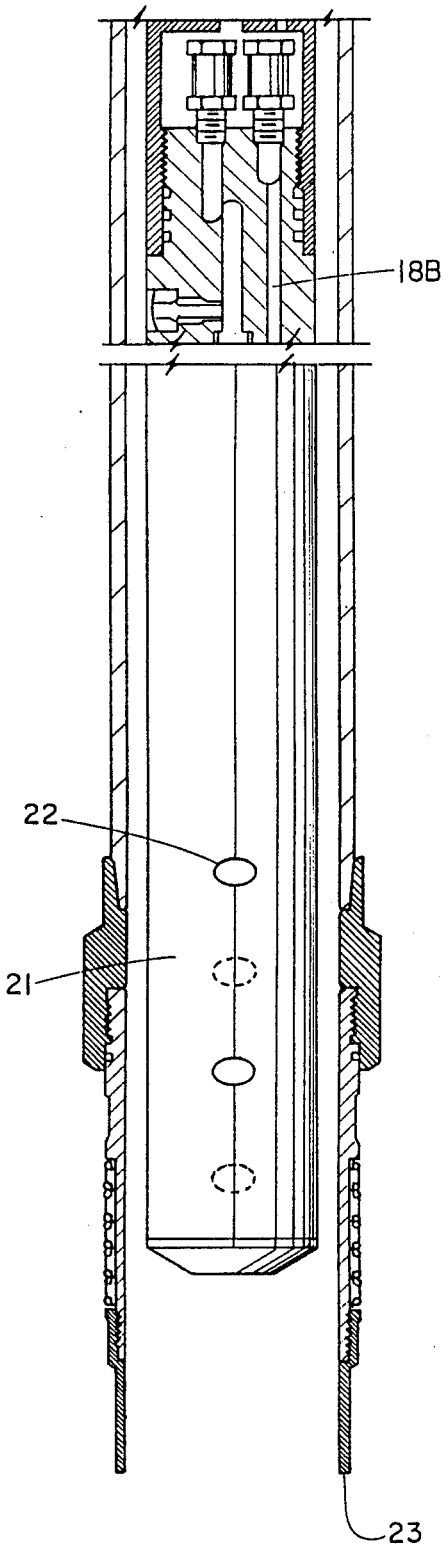
Figure 4A:
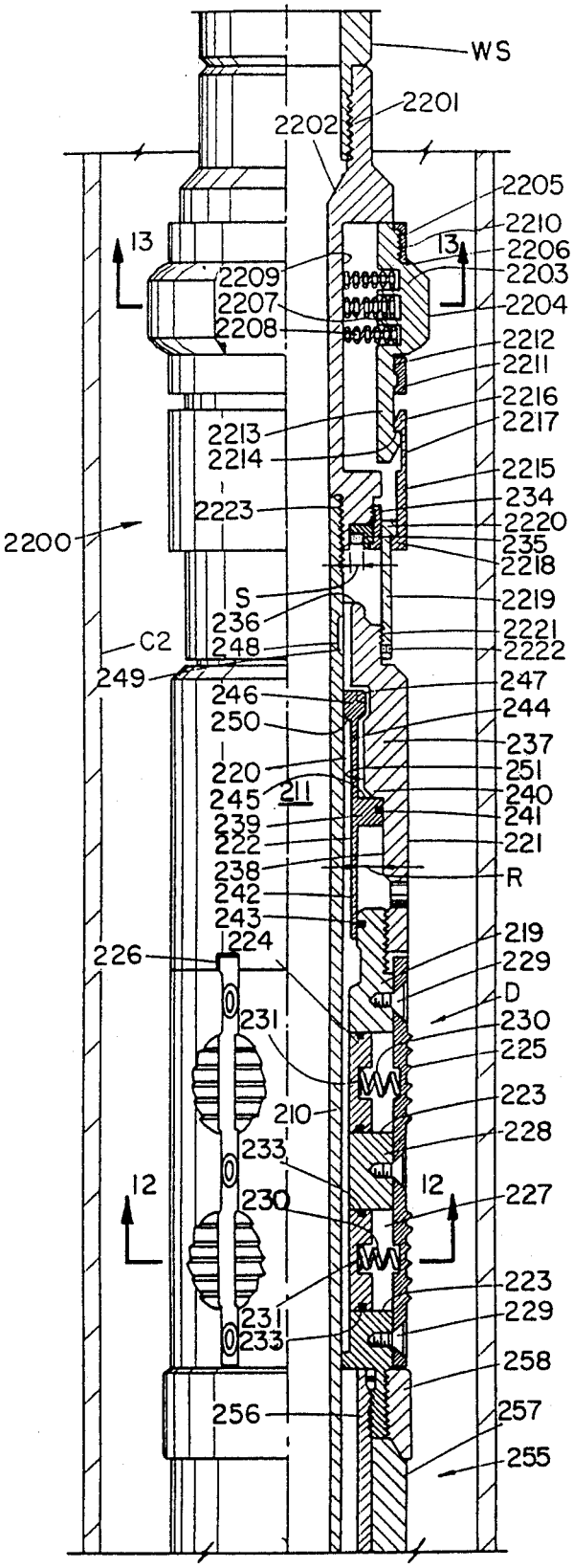
FIGS. 4A through 4B together constitute a combined side elevational and longitudinal section view through the first packer means with the device in condition for moving the tool longitudinally through a well casing, FIG. 4B constituting a lower continuation of FIG. 4A.
Figure 4B:
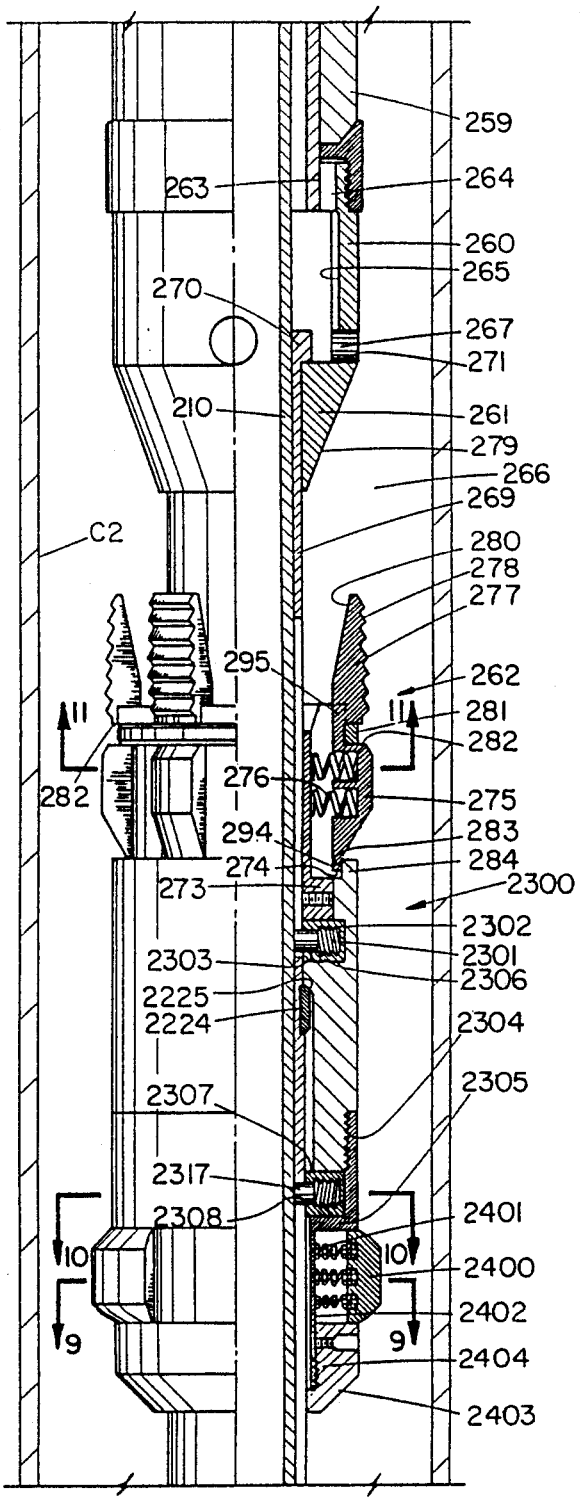
Figure 5:
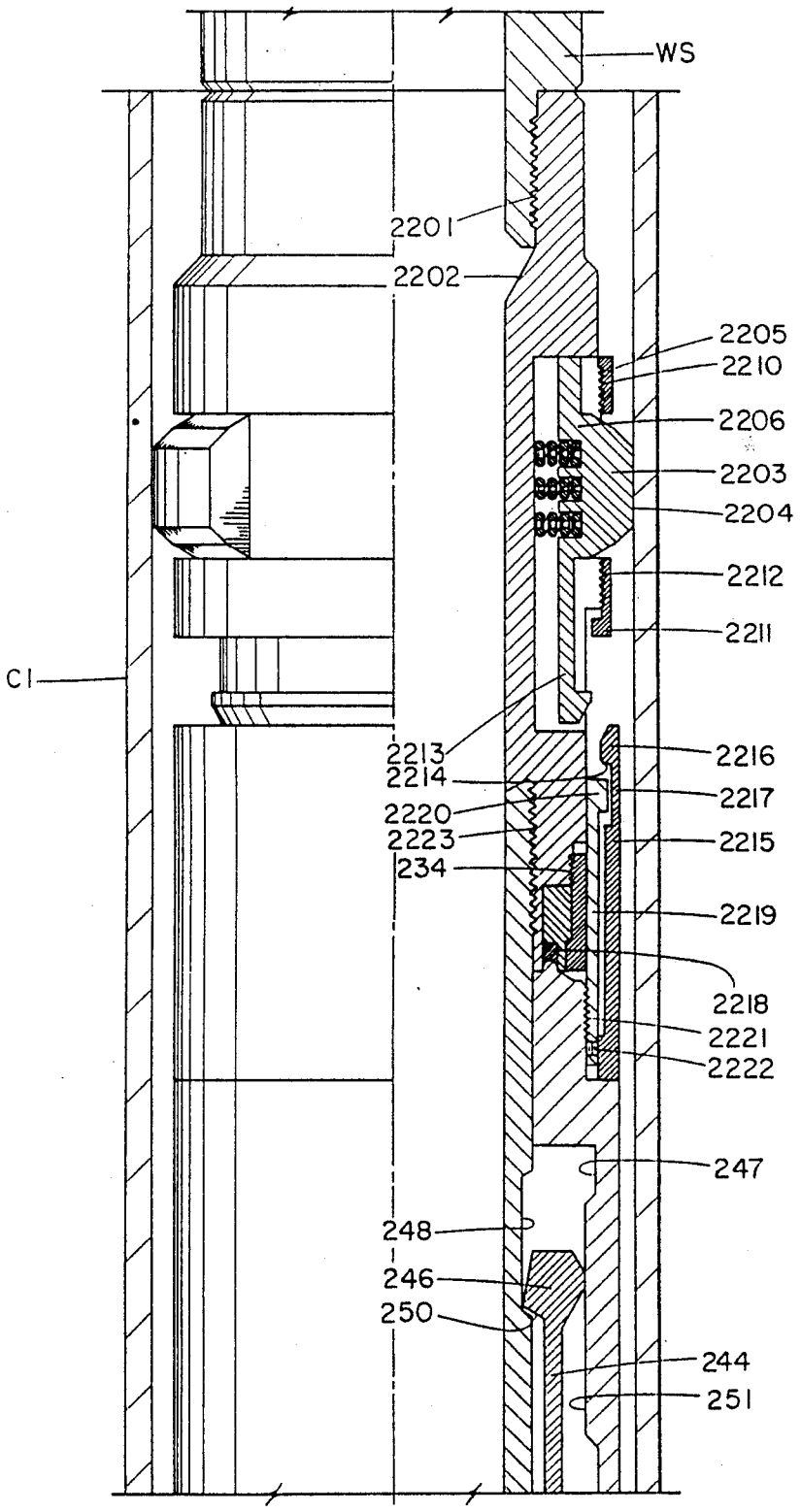
FIG. 5 is a view of the upper portion of the tool in a casing liner with the retraction maintenance means separated.
Figure 6:
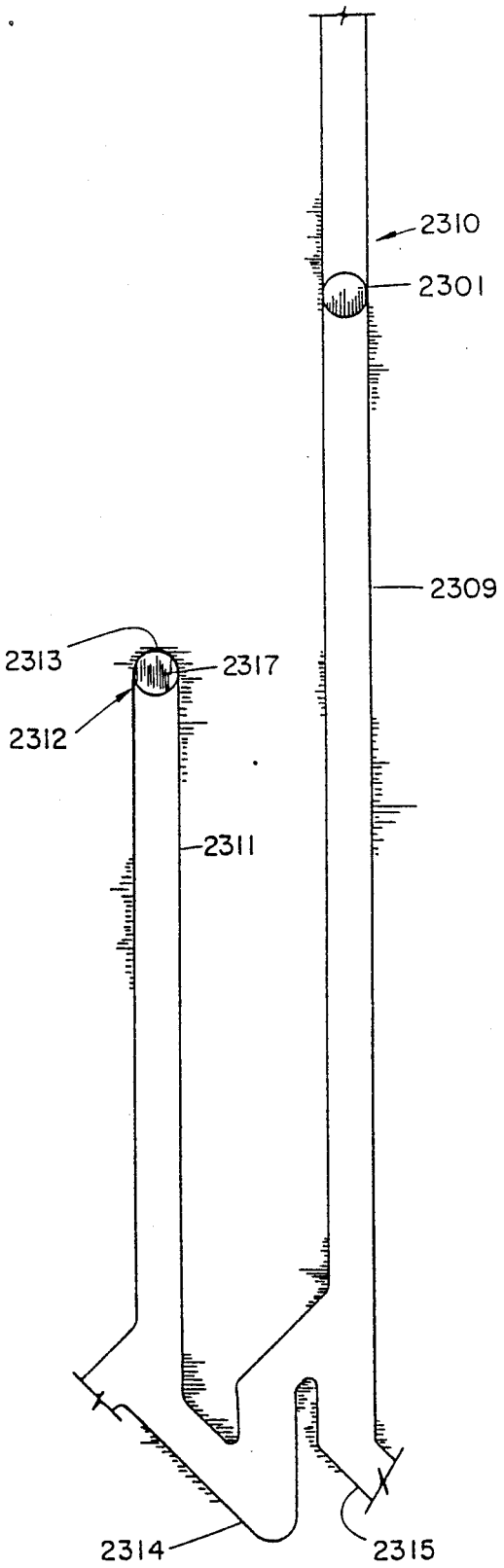
FIG. 6 is a flat planar view of the pin and slot configuration used in the first packer means manipulating procedure, shown in position during run-in of the tool into the well.
Figure 7:
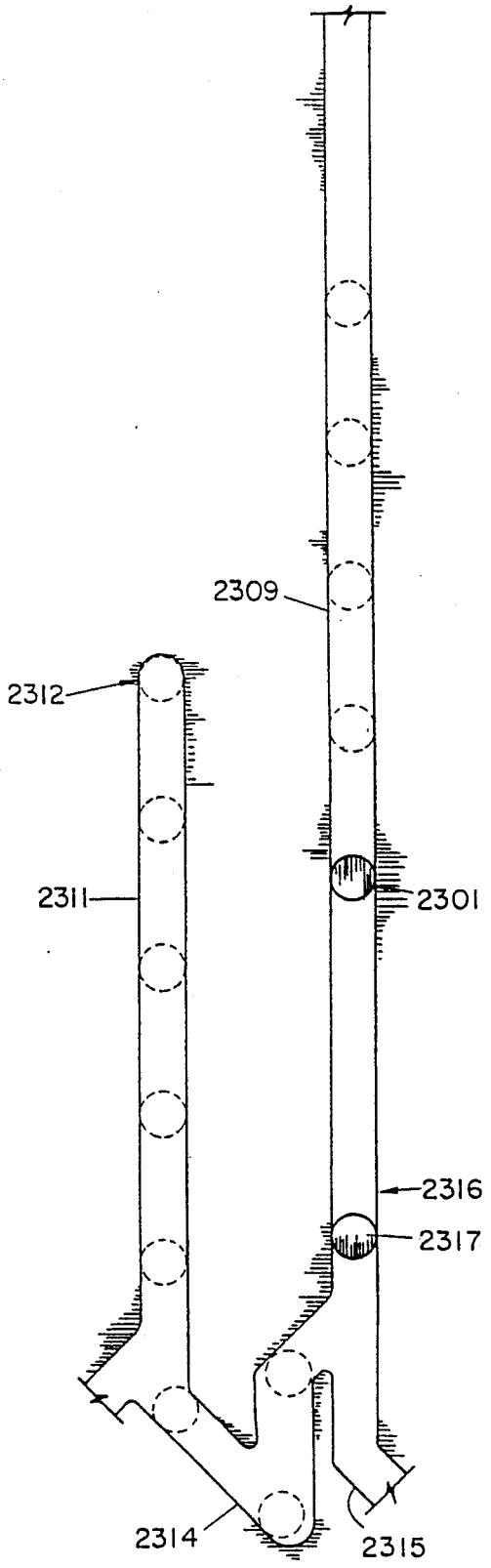
FIG. 7 is a view similar to that of FIG. 5 showing the pin and slot configuration of the first packer means in the set position.
Figure 8A:
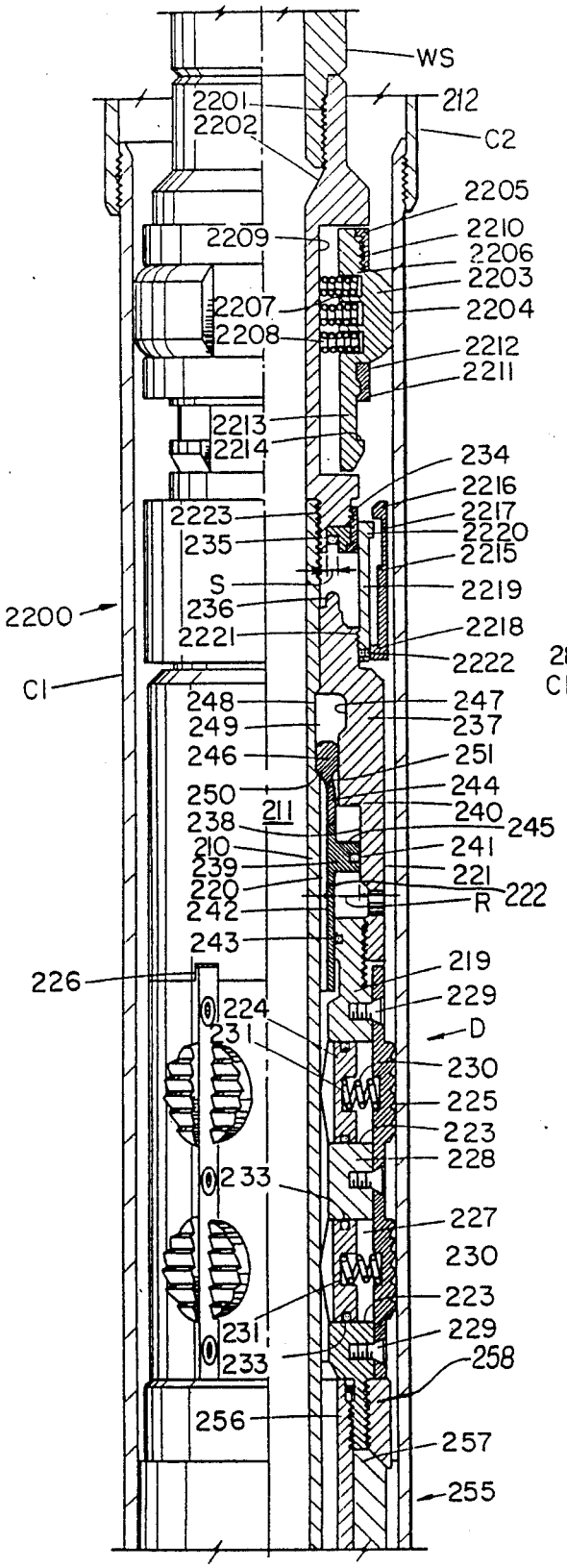
FIG. 8A and 8B are views similar to FIGS. 4A and 4B showing the tool anchored in packed-off condition in the well casing.
Figure 8B:
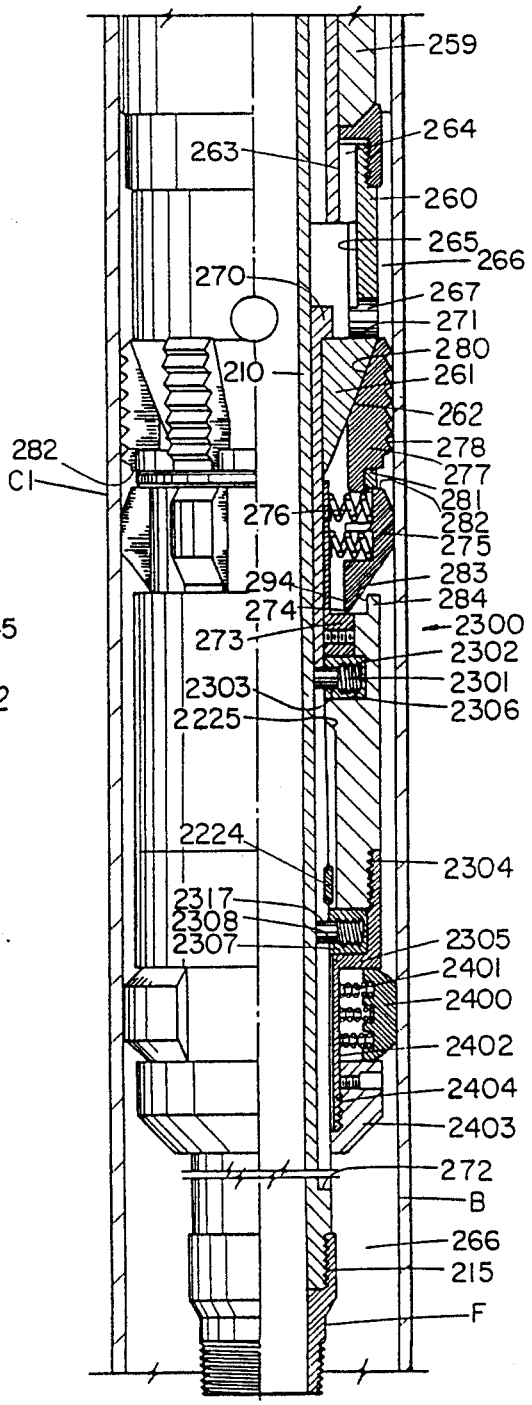
Figure 9:
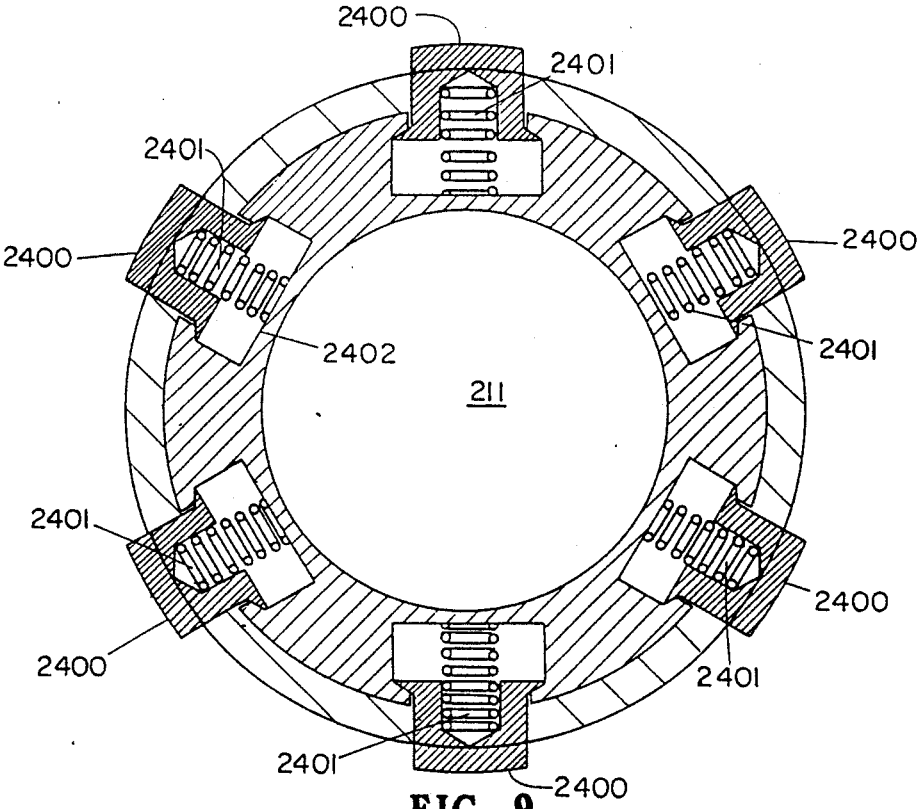
FIG. 9 is a sectional view taken along lines 9—9 of FIG. 4A.
Figure 10:
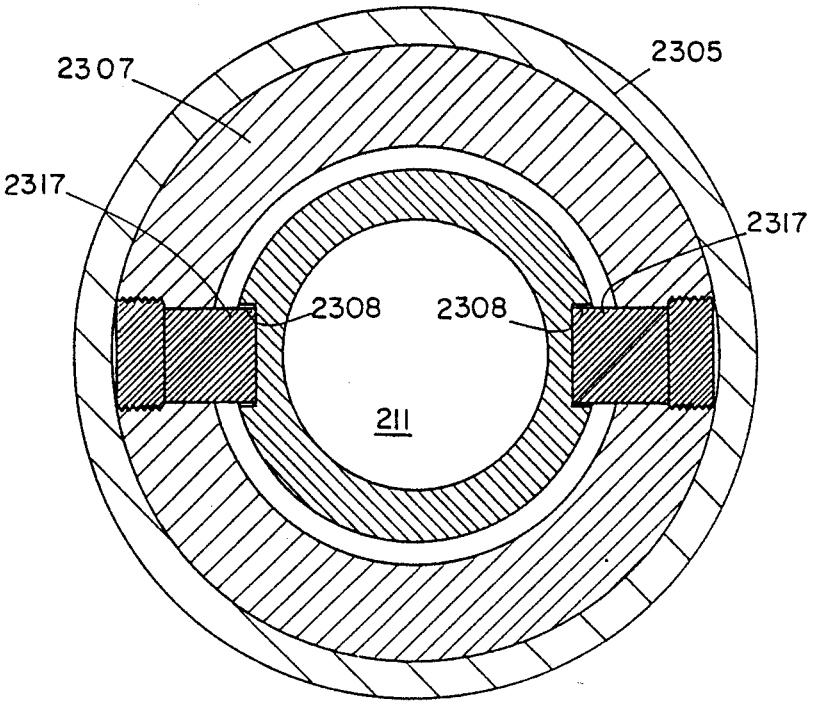
FIG. 10 is a sectional view taken along lines 10—10 of FIG. 4A.
Figure 11:
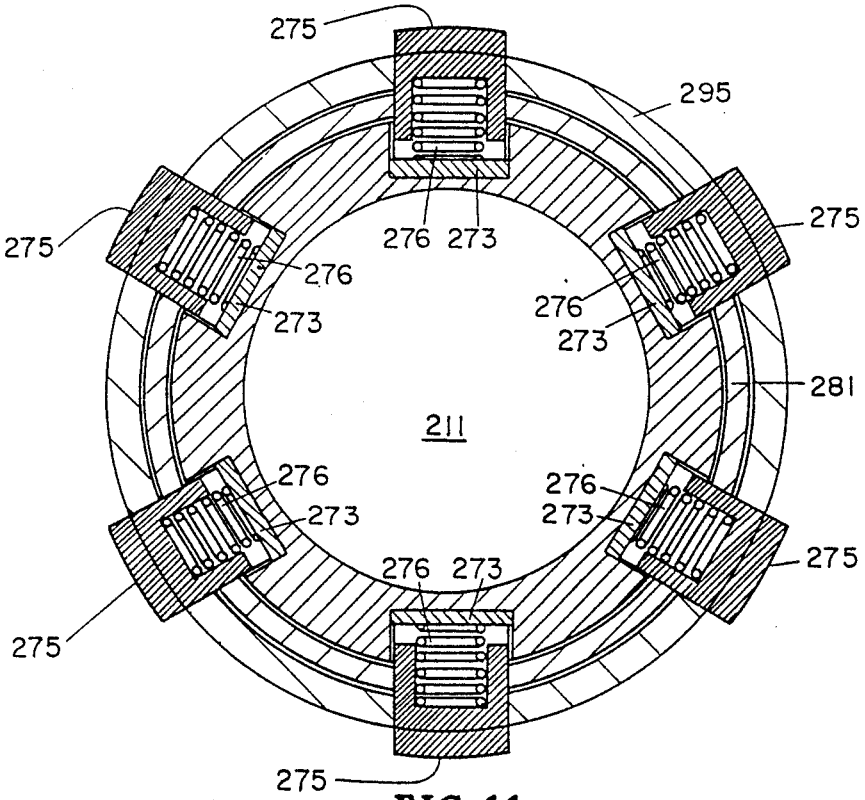
FIG. 11 is a sectional view taken along lines 11—11 of FIG. 4A.
Figure 12:
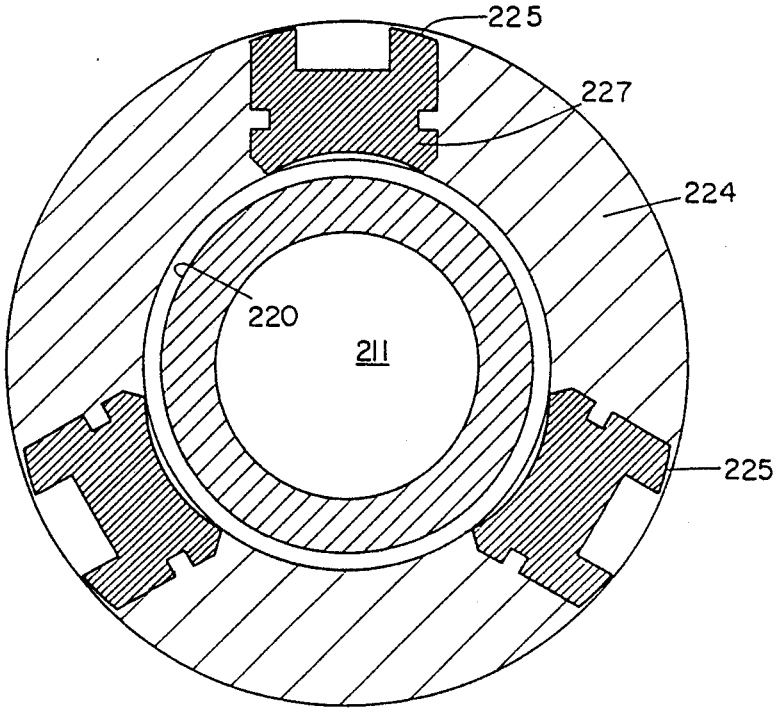
FIG. 12 is a sectional view taken along lines 12—12 of FIG. 4A.
Figure 13:
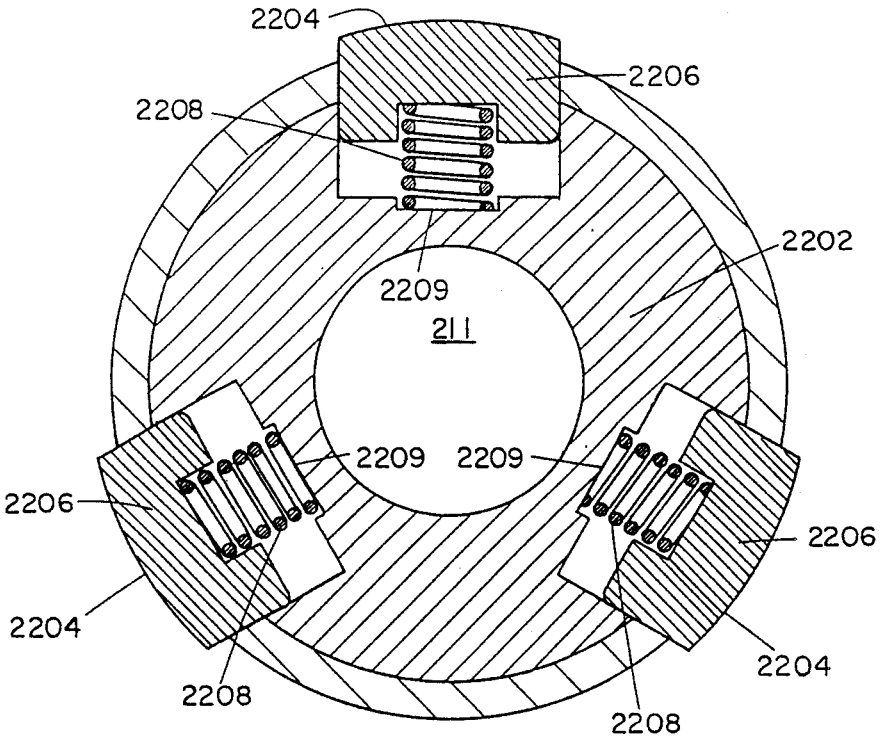
FIG. 13 is a sectional view taken along lines 13—13 of FIG. 4A.
Figure 14A:
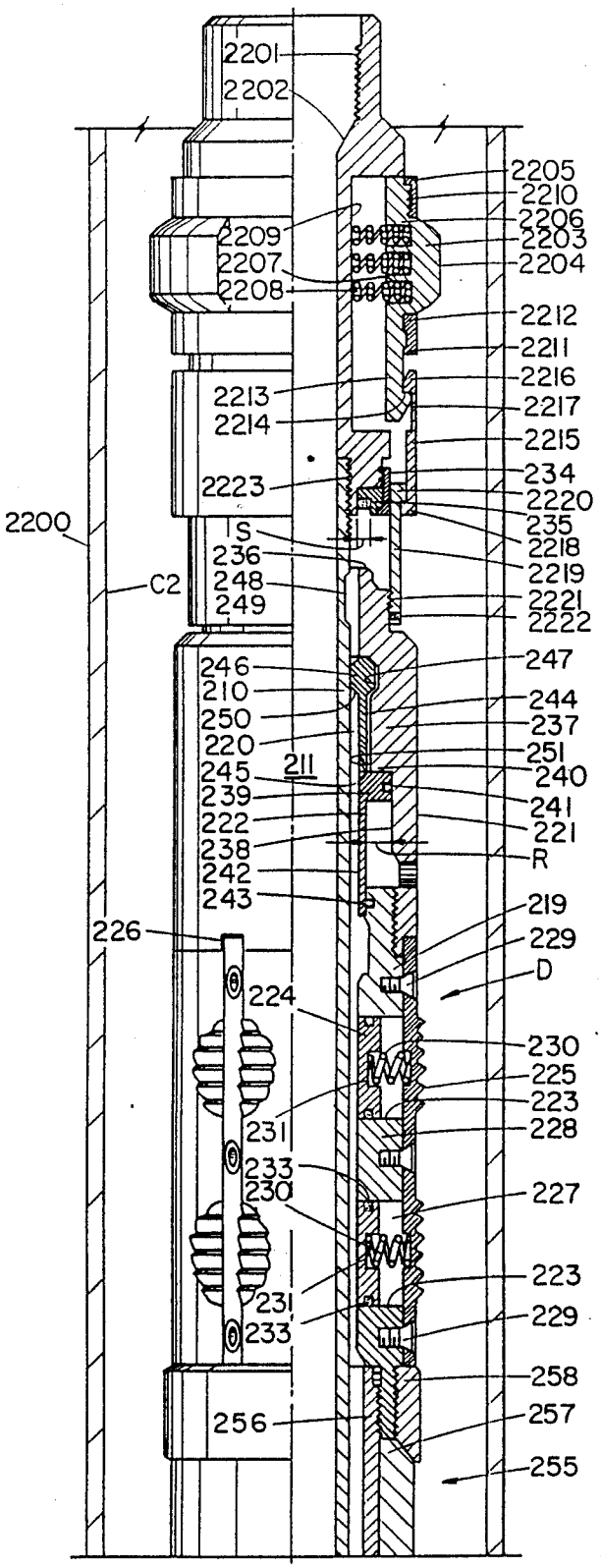
FIGS. 14A and 14B are views corresponding to FIGS. 4A and 4B showing the first packer means after having been released from the well casing.
Figure 14B:
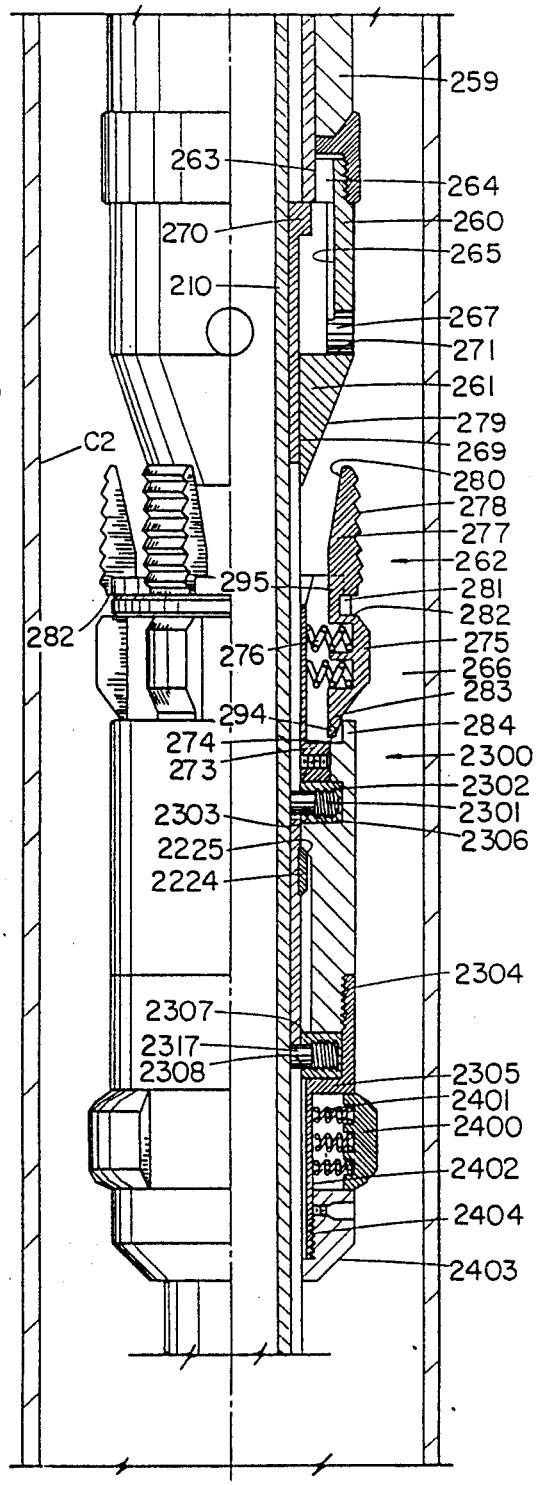
Figure 15A:
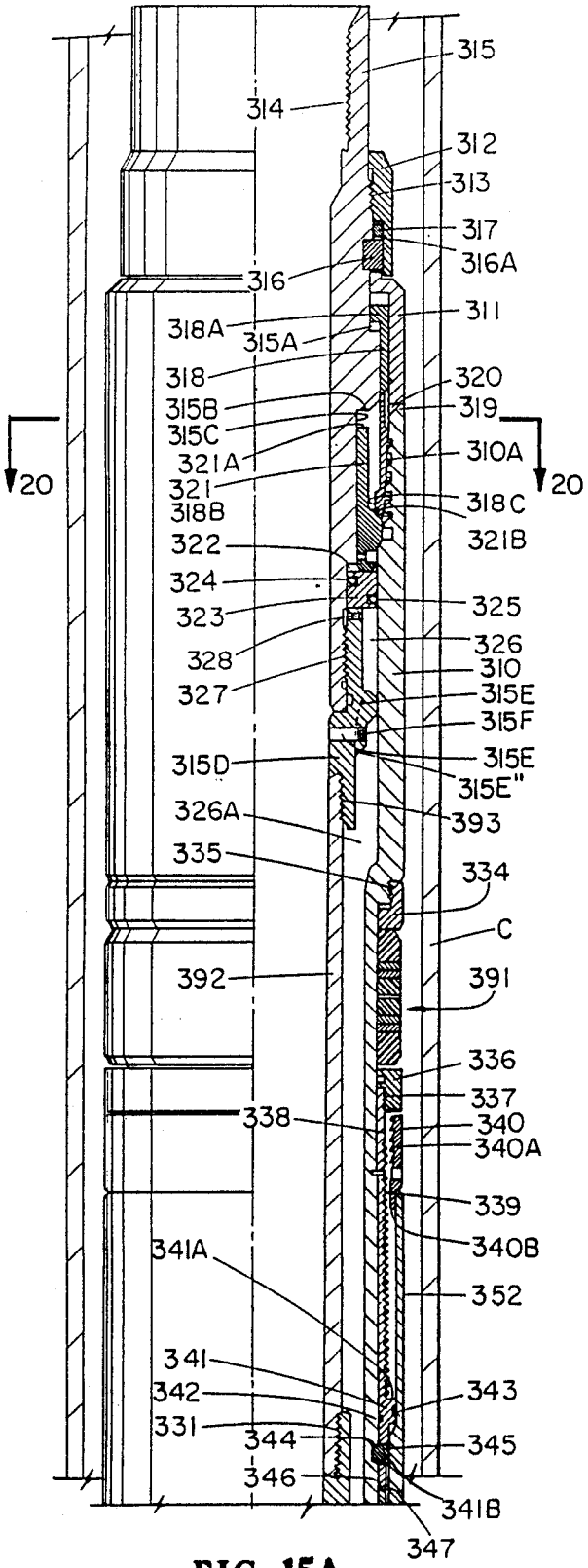
FIGS. 15A and 15B are longitudinal sectional views illustrating the second packer assembly as it is run into the well, prior to setting.
Figure 15B:
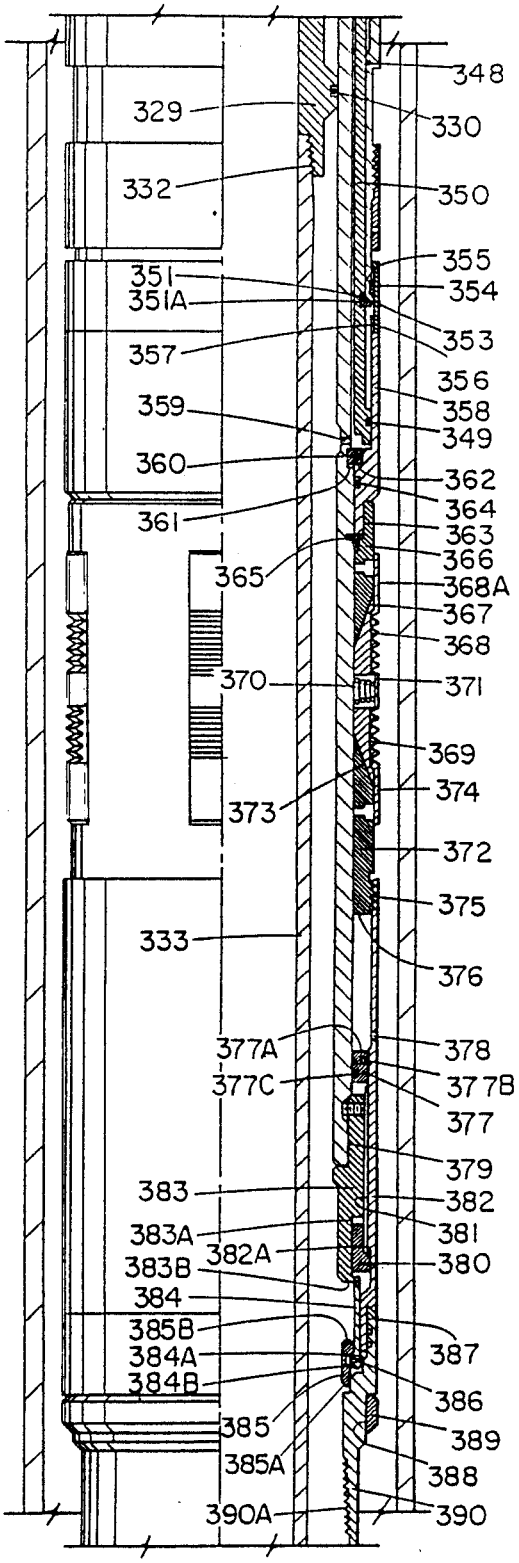
Figure 16A:
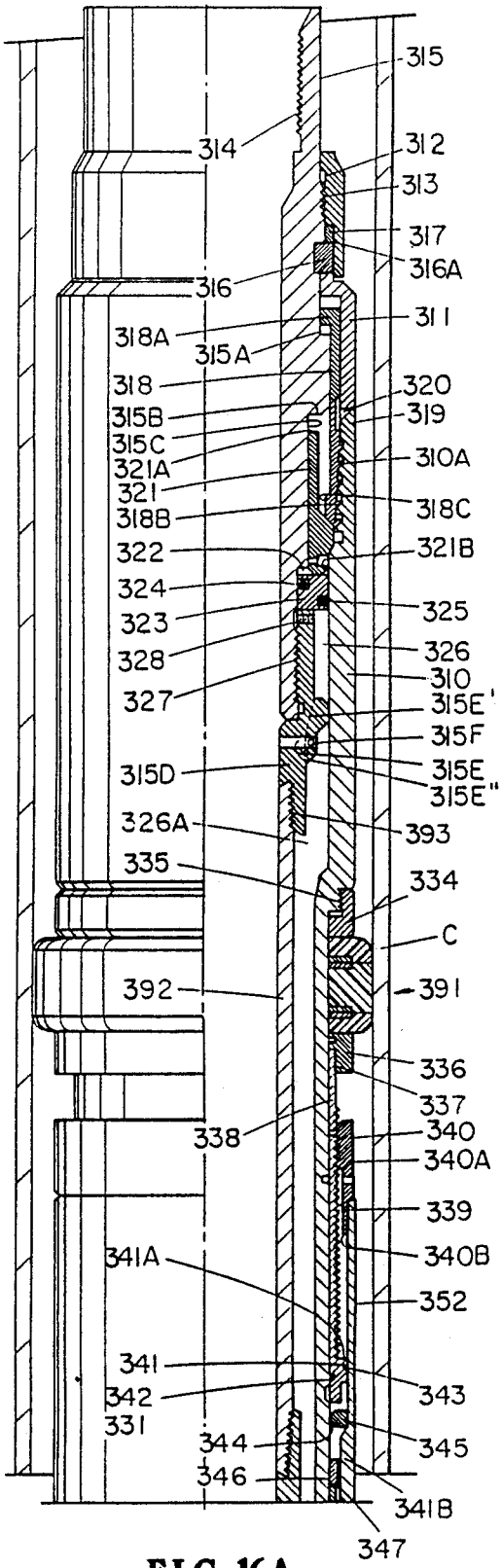
FIGS. 16A and 16B are sectional views similar to that of FIGS. 15A and 15B, illustrating the second packer apparatus as it is set within the well.
Figure 16B:
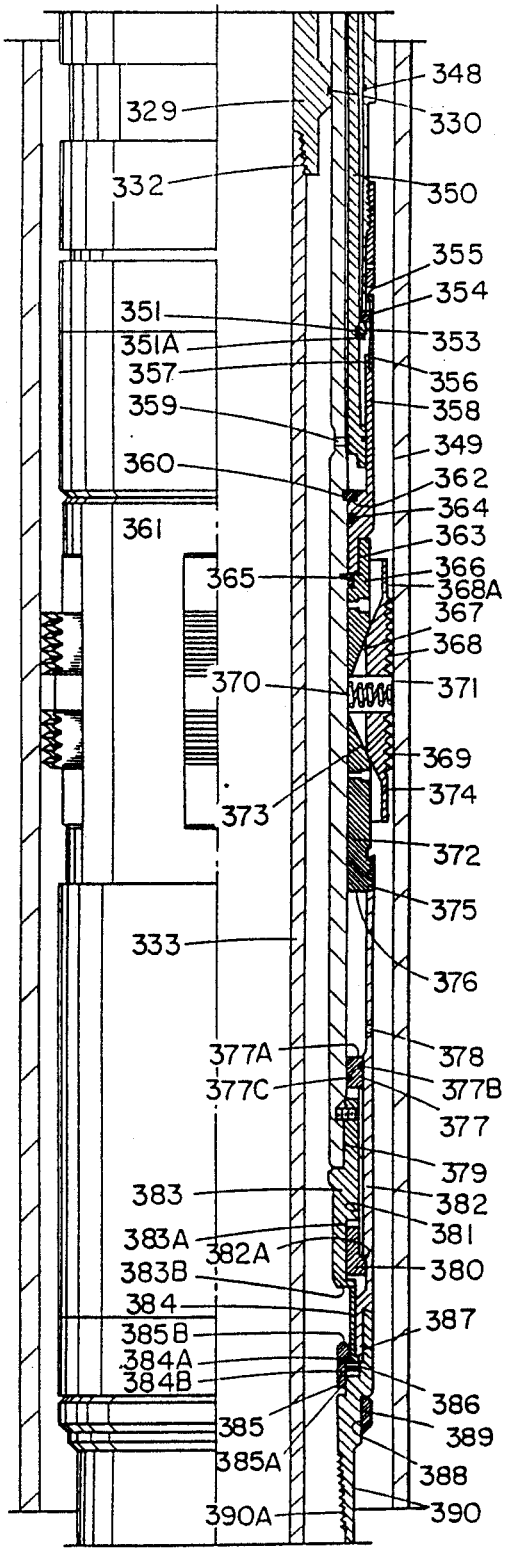
Figure 17A:
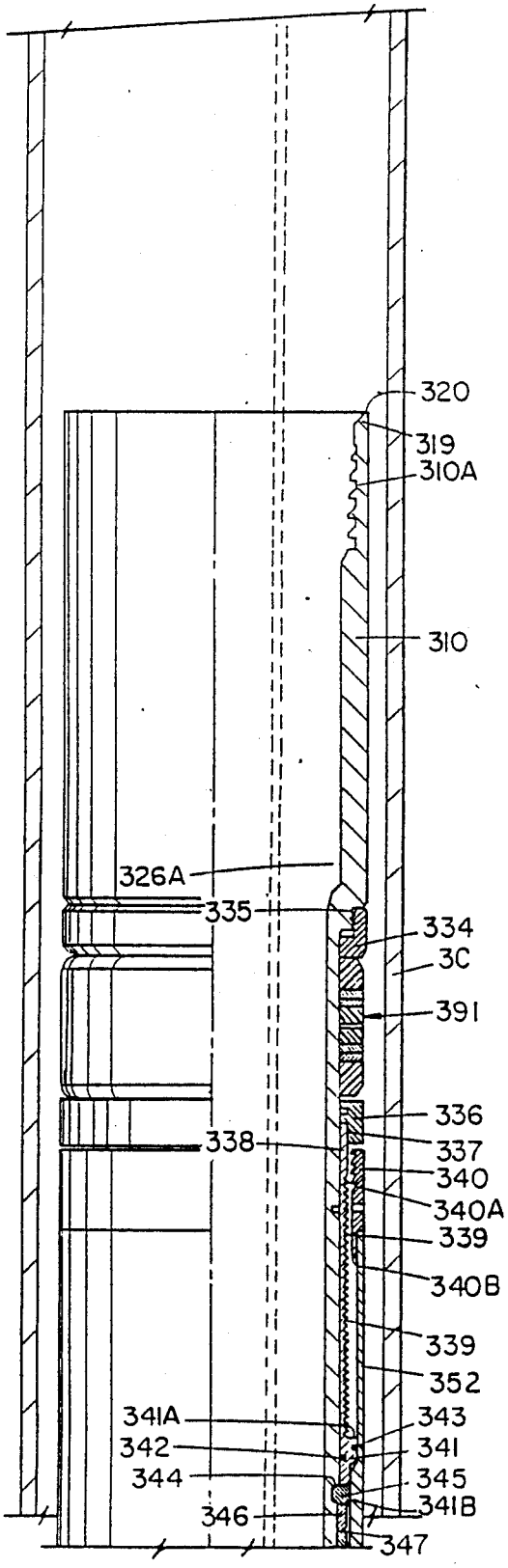
FIGS. 17A and 17B are partial sectional illustrations of the second packer means showing the release mechanism in released condition.
Figure 17B:
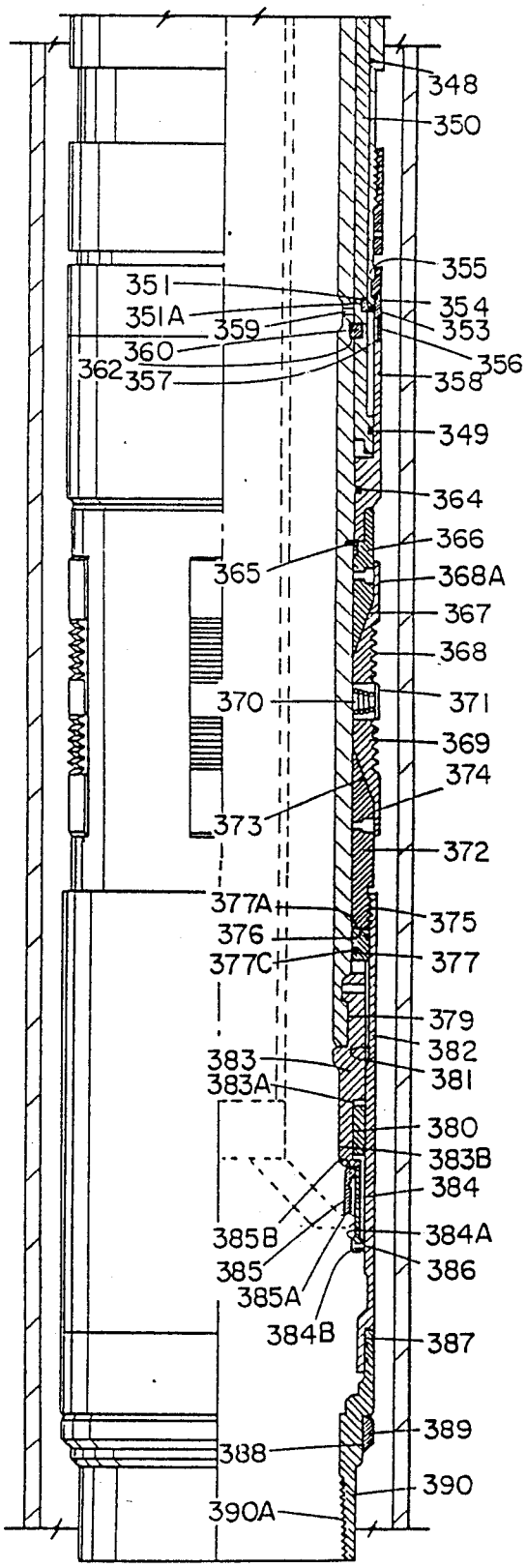
Figure 18A:
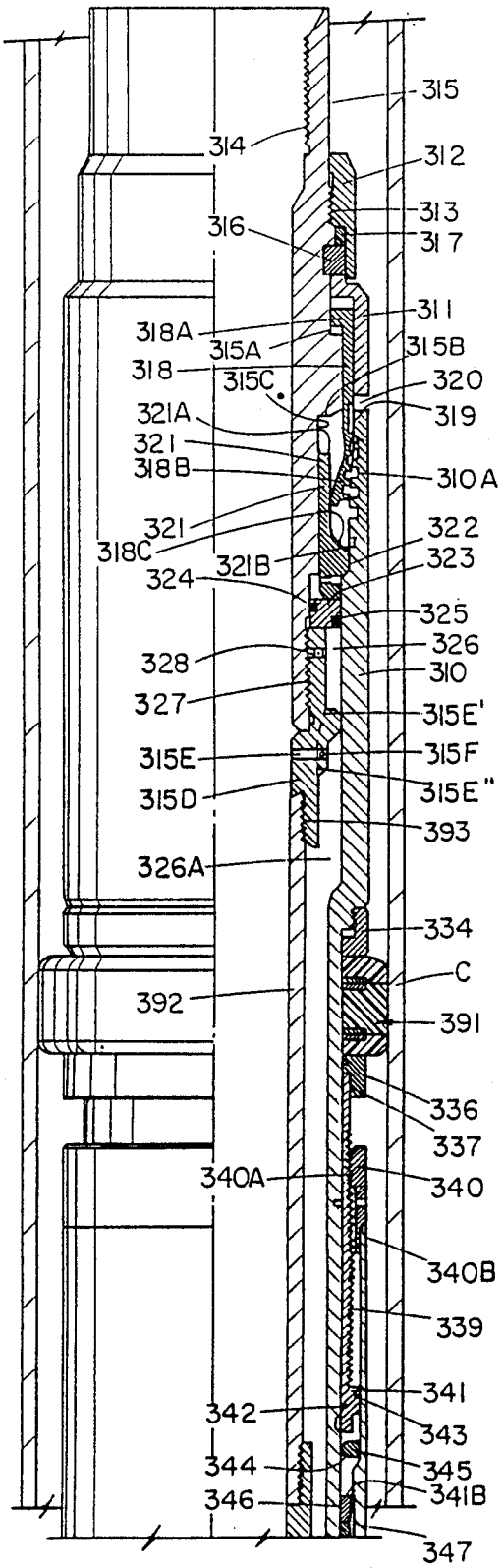
FIGS. 18A and 18B together constitute a longitudinal partial sectional illustration of the second packer assembly showing the emergency disengaging device in disengaged position.
Figure 18B:
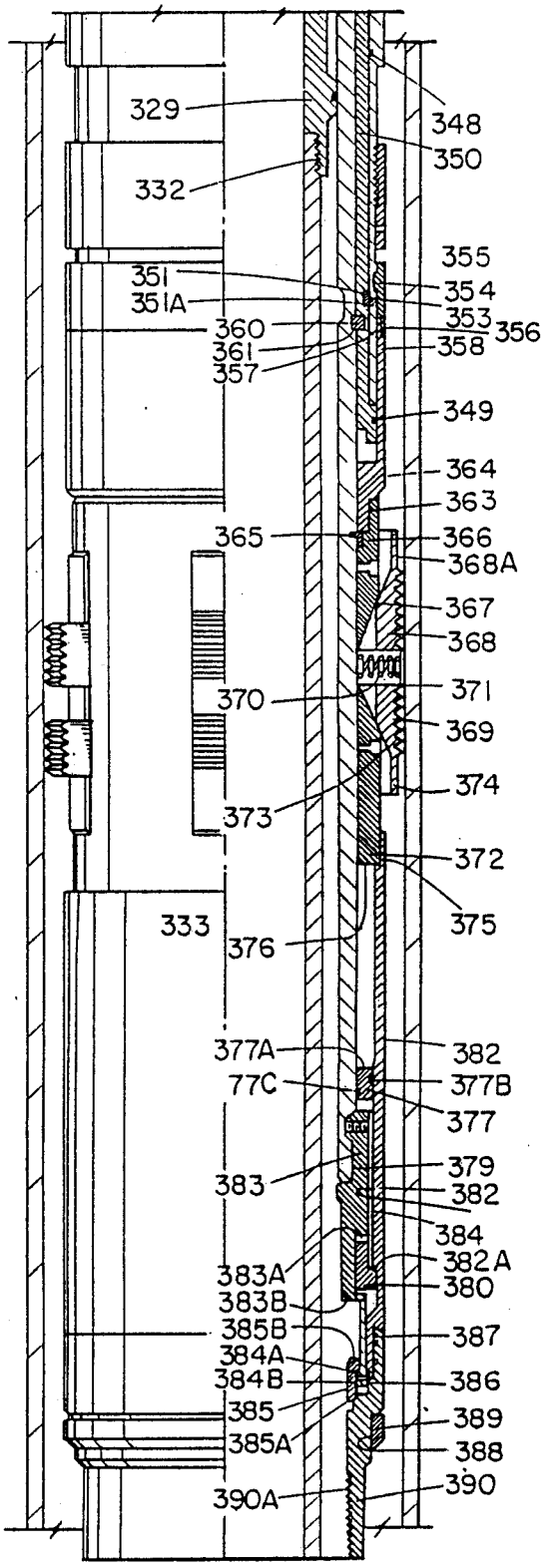
Figure 19:
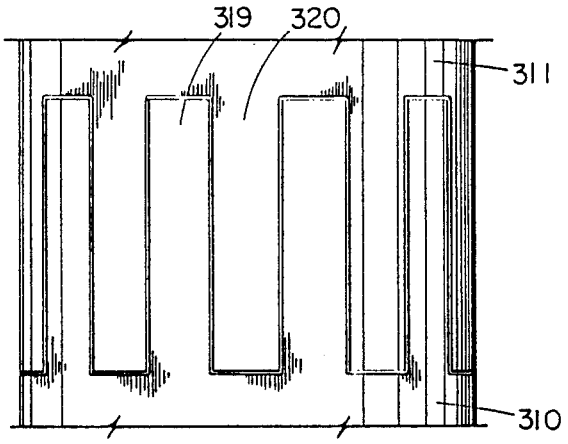
FIG. 19 is an exterior planar view showing the slot and key means of the second packer assembly of the present invention.
Figure 20:
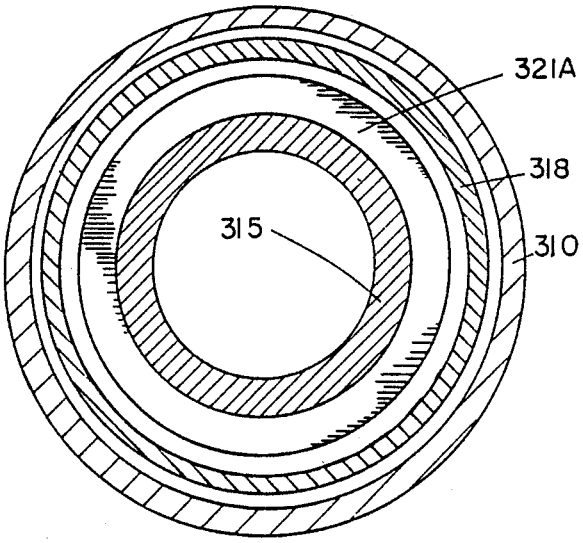
FIG. 20 is a sectional view taken along lines 20—20 of FIG. 15A.
Figure 21:
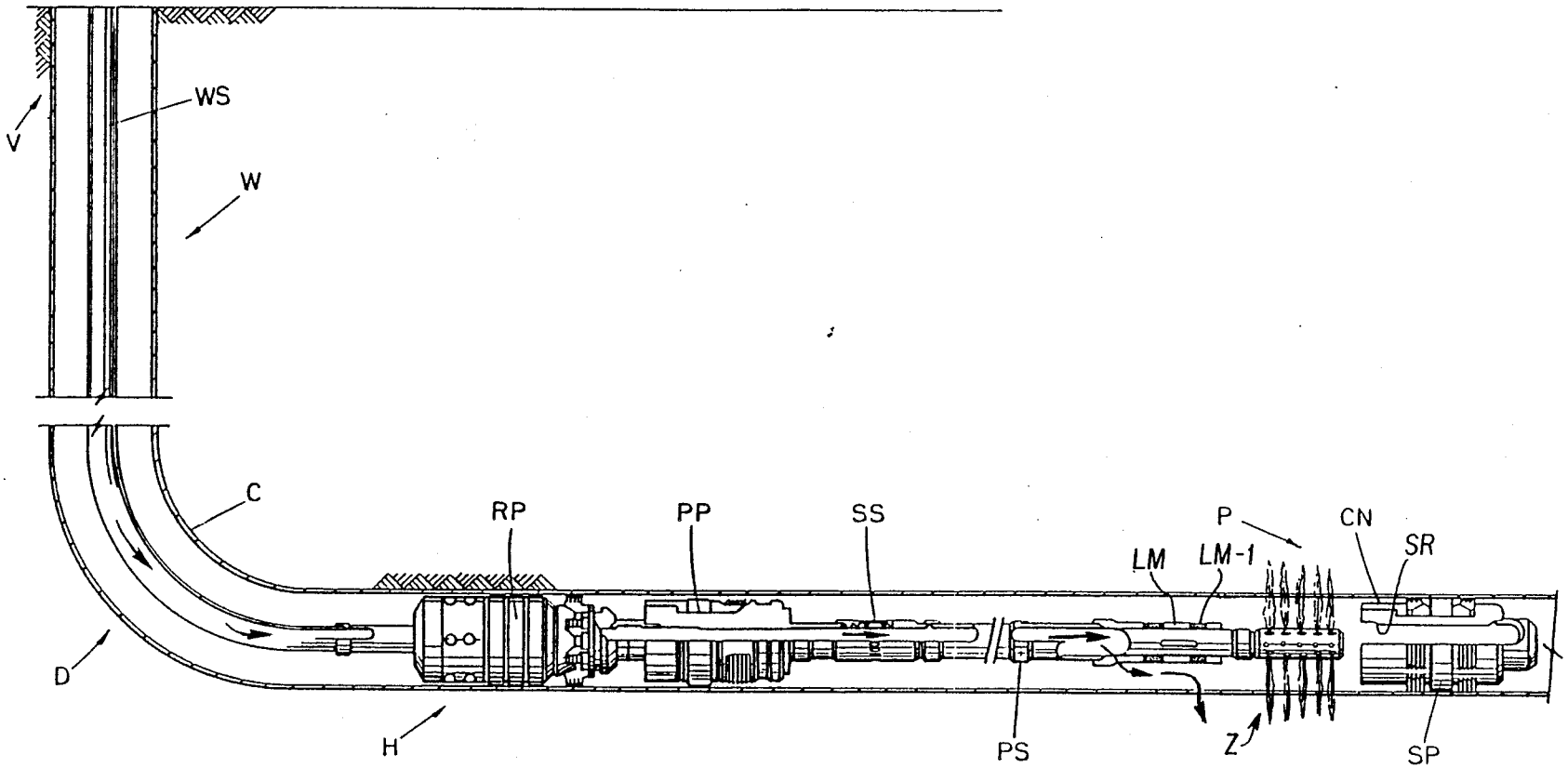
FIG. 21 is a view similar to that of FIG. 1 showing the apparatus of the present invention as the well casing is being perforated.
Figure 22:
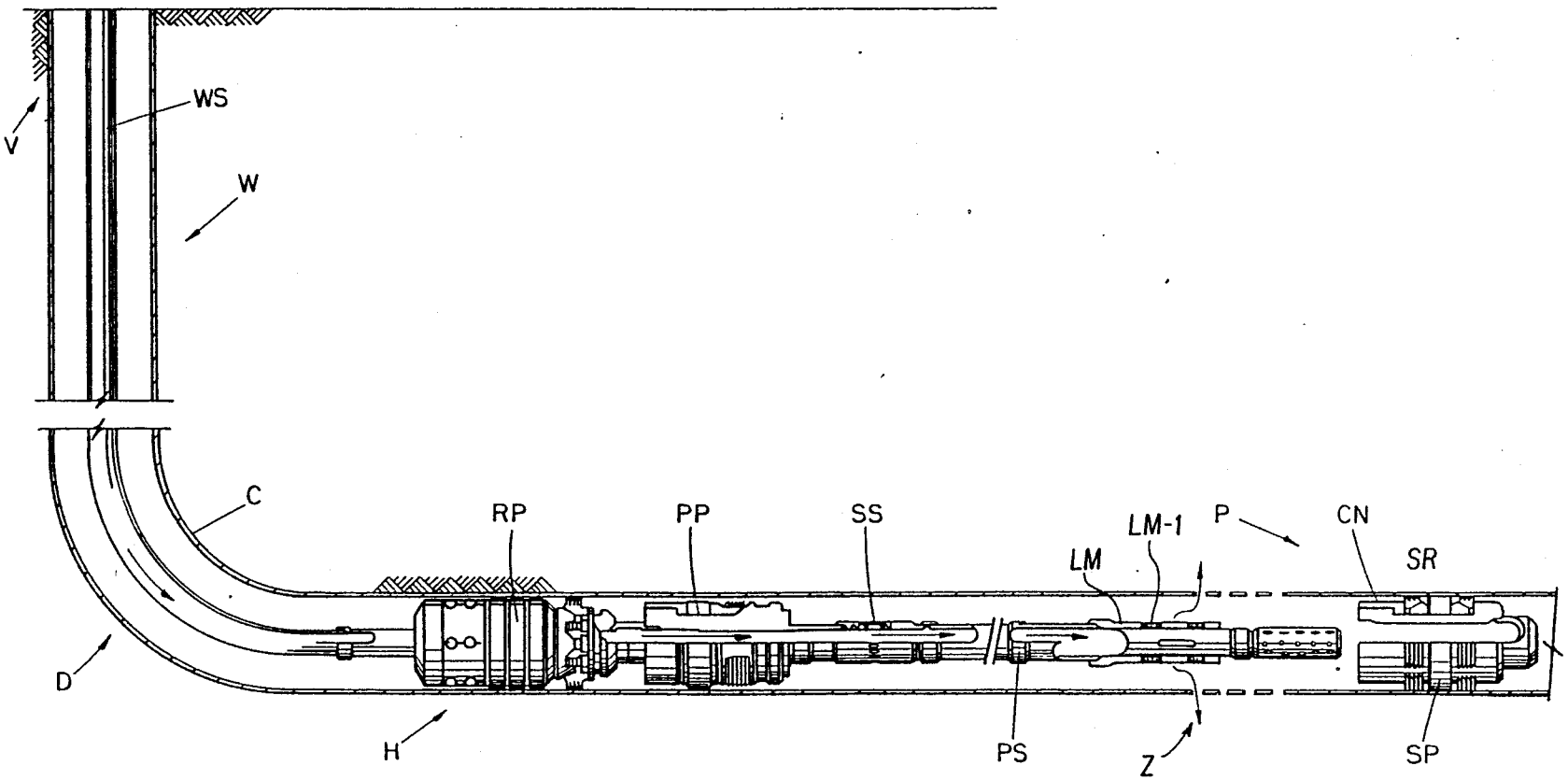
FIG. 22 is a schematic illustration similar to that of FIGS. 1 and 21 showing introduction to the production zone through the workstring and the apparatus of a treating fluid.
Figure 23:
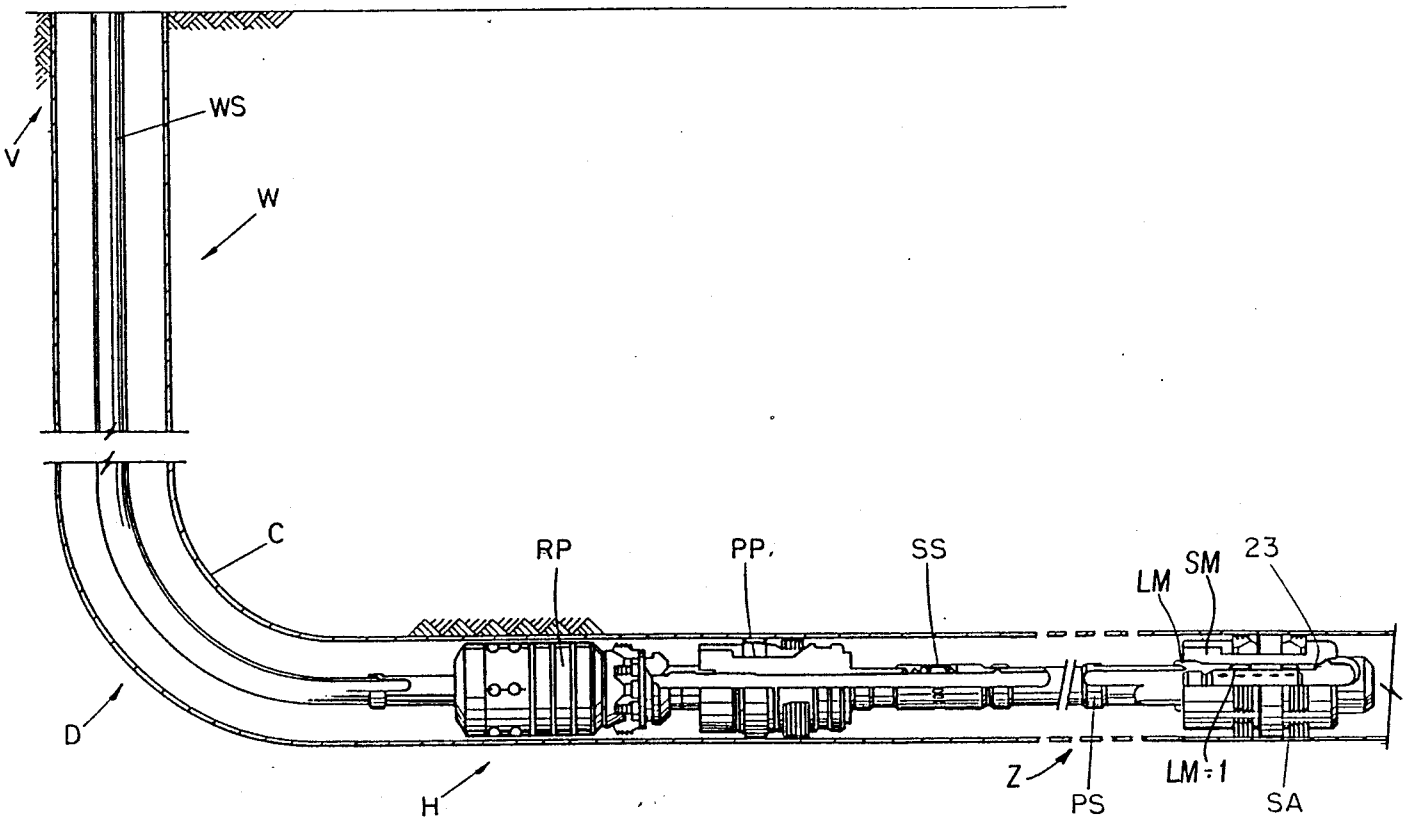
FIG. 23 is a schematic illustration of the apparatus of the present invention with the second packer means set subsequent to perforation of the well and the seal means on the locator mandrel being secured to isolate the production zone from the interior of the apparatus, the first packer means being unset for retrieval of the workstring to the top of the well together with the perforating gun and gun retractor.
Figure 24:
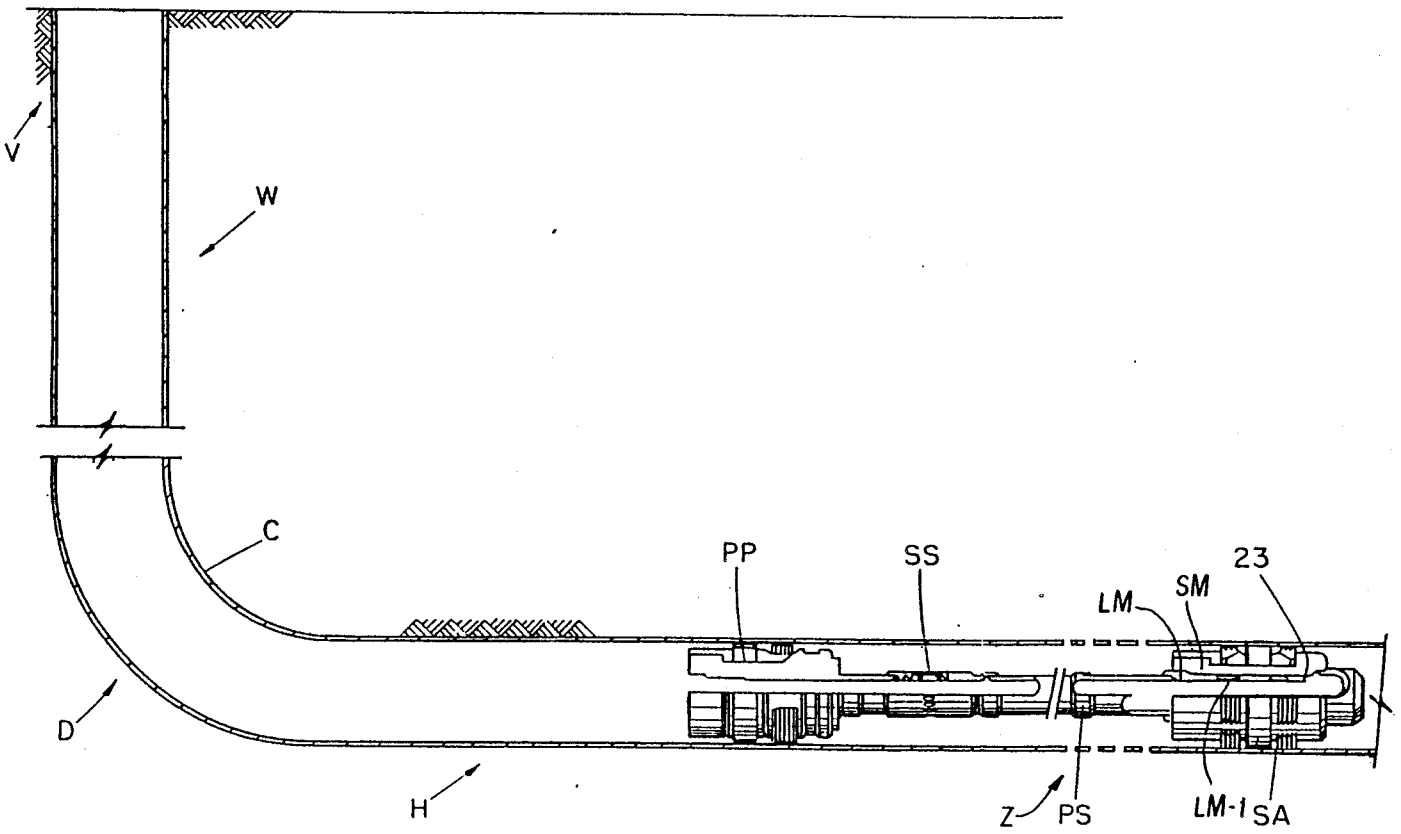
FIG. 24 is a schematic illustration showing the portion of the apparatus of the present invention which is retained within the well subsequent to retrieval of the workstring and the first packer means, with the valve means being in the closed position to isolate fluid flow from the exterior to the interior of the portion of the apparatus left within the well.

With reference to FIG. 1, there is shown a subterranean well W having a first vertical section V communicating with the top of the well and extending into a deviation or curvature thereof of D which, in turn, extends into a horizontal section H traversing a production zone P.

Prior to running the apparatus 10 into the well on a workstring WS also carrying a retrievable or first packer RP and a permanent or second packer PP, the casing C has been placed into the well and cemented therein. The casing C will have perforations therethrough subsequent to the firing of the perforating gun 21.

A section of production string PS extends from and is carried on workstring WS below the permanent packer PP with a seal assembly or locator mandrel SA circumferentially extending around the exterior of the section of production string PS approximate the end 23 thereof for selective stabbing within the interior of a connector CN extending upwardly from a sump packer SP positioned and set within the well W below the production zone P. A sliding sleeve or valve mechanism SS is provided on the production string PS and is placed initially in the open position to permit communication between the production string-casing annulus and the interior of the production string PS.

Now referring to FIGS. 2A through 2D, the gun retraction means 10 is comprised of an upper housing member 4a and a lower housing member 4b telescopically extending therefrom and secured thereto by means of a piston and a locking assembly 4c. The apparatus 10 is shown telescopically extended through the production string PS and has a housing 4 comprising an upper housing member 4a and a lower housing member 4b. The upper housing member 4a is secured by means of threads 2 to the workstring or tubular conduit 1 with a series of circumferentially extending elastomeric O-ring seal elements 3 disposed between the upper housing member 4a and a solid connection portion of the tubular conduit 1. The upper housing member 4a is cylindrical and within its interior is the first chamber 5 which is filled with a body of fluid, such as clean water, at the top of the well before the apparatus 10 is introduced within the well W.

The upper housing member 4a joins the lower housing member 4b telescopically extending through the lowermost end thereof with a piston and locking assembly disposed between the housing members 4a, 4b, as discussed, below.

Within the piston and locking assembly 4c is a piston 6 slidably carried along the smooth interior wall of the upper housing member 4a, a seal assembly 6a carried around the exterior of the piston 6 preventing fluid transmission across the piston 6 and the upper housing member 4a. The piston 6 has a central flow passageway 6b extending therethrough and terminating at the lower end 7e of a pressure relief valve assembly 7 which, in turn, has an upper opening 7d directly communicating within the interior of the first chamber 5 thereabove. The pressure relief valve 7 has a biasing spring member A extending to a head member 7b selectively sealingly engagable relative to a seat member 7c therefor.

The pressure relief valve 7 is a one way acting valve, that is, the spring 7a biases the head 7b towards the seat 7c such that fluid within the first chamber 5 is prevented from passing from within the chamber 5 and lowerly through the flow passageway 6b until such time as a pre-determined pressure is exceeded, said pre-determined pressure being the biasing rating of the spring 7a in the opposite direction.

The piston 6 provides at its lowermost end a series of circumferentially extending elastomer seals 6c to prevent fluid communication between the piston 6 and a lock dog housing 11 secured thereto by means of threads 11b.

The lock dog housing 11 also carries a free piston 8 selectively movable within the interior of the piston and locking assembly 4c and carried in spaced relation below the piston 6 and above a piston connector 9. The free piston 8 has a fluid passageway 8b in companion communication with the flow passageway 6b of the upper piston 6. Elastomer seals 8a are provided at the uppermost end of the free piston 8 to prevent fluid communication between the free piston 8 and the lock dog housing 11. A similar series of seals 8d is disposed around the lower exterior of the free piston 8 to also prevent fluid communication between the piston 8 and the lock dog housing 11. Similarly, seals 8e extend from a nose portion of the free piston 8 and into the smooth interior wall of the piston connector 9 therebelow to prevent fluid communication between the connector 9 and the free piston 8.

A release groove 8c is defined around the exterior of the free piston 8, the groove 8c having a diameter somewhat smaller than the balance of the diameter of the free piston 8 for selective receipt of locking dogs 10 which are caused during the telescoping action, described below, to be snapped into contracted position into the release groove 8c to permit the free piston 8 to travel upwardly to permit communication between the passageway 8b within the free piston 8 and flow passageway 9e carried through the interior of the piston connector 9. The free piston 8 is secured to the lock dog housing 11, initially, by means of a shear pin 11a.

The housing 4 has a running groove 10a for initial receipt of the locking dogs 10, such that when the dogs 10 are in the running groove 10a longitudinal movement of the free piston 8 relative to the upper housing member 4a is prevented.

The piston connector 9 is secured at threads 9c to the lock dog housing 11 and has a series of upper elastomeric seal members 9a placed circumferentially around its uppermost exterior to prevent fluid communication with the lock dog housing 11 thereabove. A similar series of seals 9b extend around the lower exterior of the piston connector 9 to prevent fluid communication between the connector 9 and an extension 4c of the lower housing member 4b. The extension 4c is secured at threads 4d to the lower housing member 4b and seals 4e prevent fluid communication between the extension 4c and the lower housing member 4b. The extension 4c is secured at threads 9d to the connector piston 9. The piston connector 9 is, in turn, secured by threads 9c to the lock dog housing 11. The connector 9 has a hollow interior through which extends a bored flow passageway 9e. Initially, fluid flow through the passageway 9e is prevented from passing within the passageway 8b of the free piston 8 by means of the seals 8d, 8e. However, as described below, when the free piston 8 is shearably released from the lock dog housing 11, the passageways 9e, 8b are permitted to fluidly communicate with one another for transmission of well pressure, as described below.

The free piston 8 has an end 8f which rests upon the uppermost face of the piston connector 9 when the free piston 8 is engaged to the lock dog housing 11 by the shear pin 11a.

The flow passageway 9e extends lowerly into a connector 12 which secures the uppermost end of a well pressure tube 13 which extends completely through the lower housing member 4b therebelow and interiorly of a second chamber 5a within the lower housing member 4b and threadably terminating into engagement with a lower connector 14. The connector 14 houses a rupture disc 15 which prevents fluid transmission through the connector 14 and the tube 13 extending therethrough with the disc 15 rupturing at a pre-determined pressure as well pressure is defined thereacross subsequent to the firing of the gun 21. Typically such discs 15 will shear at approximately 1000 psi, but such shear rating is, of course, entirely selective.

The connector 14 is threadably engaged within an adaptor 16 which defines the terminal end of an inner housing 61 of a shock absorber assembly 60 secured at threads 62 to the lower housing member 4b with the interior of the inner housing 61 being a lower extension of the housing 4b. The adaptor 16 has a series of seals 16a at its uppermost end to prevent fluid communication between the adaptor 16 and the inner housing 61.

A tubing extension 17 is sealingly and threadably secured into the lowermost end of the adaptor 16 for fluid communication with the connector 14 and the well pressure tube 13. The tubing extension 17 has its lower end open and facing within the firing head housing 18 secured at threads 69 to the outer housing 64 of the shock absorber assembly 60 thereabove with seals 19 disposed around the exterior of the firing head housing 18 to prevent fluid communication between the housing 18 and the housing 64.

The tubing extension 17 extends into engagement with a well tubing connector 20 having an opening 20a at its lowermost end extending within the firing head housing 18 of the firing head assembly 18a and communicating through a generally defined well flow passage 18b through the firing head assembly 18a which, in turn, communicates to the well exterior of the end 23 of the production string PS and interior of the casing C to pressure in the well transmitted through the perforations after the gun 21 has been fired, with such pressure extending through the gun 21 through the open shot holes 22.

The production string PS has a seal assembly SA extending at its lowermost end which is selectively sealingly stabbable into a connector CN extending upwardly from the sump packer SP, subsequent to retraction of the gun 21, described below.

Within the lower housing member 4b is the second chamber 5a which, initially, contains only air, or other gaseous substance, at atmospheric pressure, and is selectively communicable with the first chamber 5 by means of the passageway 8b through the free piston 8 and the flow passageway 6b through the piston 6 such that as telescopic movement between the upper housing member 4a and the lower housing member 4b is effected, the fluid within the first chamber 5 is permitted to be transferred into the lower housing member 4b during such telescopic motion.

The piston and locking assembly 4c includes locking means 50 comprising a lock nose 51 carried by means of threads 53 on the lowermost end of the upper housing member 4a. The lock nose 51 has a beveled profiled inner surface 52 having a lowerly extending contracting inner diameter to urge a slip member 54 circumferentially carried interiorly of the lock nose 51 interiorly toward the outer exterior of the lower housing member 4b in the event that the member 4b is urged into expanding direction during or subsequent to the telescopic action, described below. The slip 54 also has a series of circumferentially subscribed serrated teeth members 54a on its interior for gripping into the lower housing member 4b to prevent such telescopic expanding movement of the member 4b relative to the member 4a. A ring member 54b is carried around the exterior of the slip assembly 54 to urge same toward the housing member 4b as the slip 54 moves downwardly and is interiorly contracted by means of the profile 52 on the lock nose 51.

A lock dog 55 is also housed within a lock nose 51 and has a companion garter ring 55a therearound to urge the dog 55 into contracting relationship relative to the member 4b.

If the lower housing member 4b is urged in expanding direction during or after telescopic interaction, the lock dog 55 will act on the slip 54 to urge it against the lock nose 51 such that the profile 52 will cause the slip 54 and, correspondingly, the teeth 54a into further gripping engagement with the lower housing member 4b to lock the member 4b in the telescopically contracted position.

The apparatus 10 also provides a shock absorber system 60 (FIG. 2C) to prevent shock incurred as a result of the firing of the gun 21 from being delivered through the tubular members, such as the lower housing member 4b, etc. The shock absorber 60 has an inner housing 61 which is also the lowermost portion of the second chamber 5a and is secured to the central lower housing member 4b by means of threads 62. A top sub member 63 is carried exteriorly around the inner housing 61 and is secured at threads 62 to an outer housing 64 with a series of elastomeric rubber rings 65 in stacked relationship between the outer housing 64 and the inner housing member 61. A series of resistance shoulders 66, 67, 68 and 70 are provided for impact load transfer to threads 69 securing the firing head housing 18 to the outer housing 64. Any upward loading transmitted through the firing head housing 18 to the outer housing 64 will be absorbed by the elastomer rings 65 and upon the shoulders 67, 70, with downward load being carried through the shoulder 68, 66.

OPERATION OF THE GUN RETRACTION MEANS

The gun retraction means 10 used in the present invention carries the gun 21 and the firing head assembly 18 secured therebelow. When the apparatus 10 is run into the well, the gun 21 and firing head assembly 18 are placed in telescopically extending position and are secured directly to the lower housing member 4b which is secured to the upper housing member 4a in expanded position by means of the interengagement of the locking dogs 10 in the running groove 10a and the shearably secured free piston 8 with the shear pin 11a in engagement to the lock dog housing 11.

Prior to running of the apparatus 10 into the well W, the lower housing member 4b will contain a gas, such as air, at atmospheric pressure. The first chamber 5 will be filled with water, or other liquid, also at atmospheric pressure. The apparatus 10 now may be run into the well W and positioned adjacent the production zone P and carried into the well on a packer, such as the retrievable packer RP carried into the well on a workstring WS. The production string PS also may be carried into the well on the retrievable packer RP and is hung from the lowermost end of the permanent packer PP also carried into the well and extending from the retrievable packer RP. The retrievable packer RP is first set, and the gun 21 is actuated, in known fashion, to cause perforations to be placed through the casing C and the production zone P. Now, increased well pressure will come within the bore interior of the casing C, through the open shot holes 22 in the gun 21 and will be transmitted through the well flow passage 18b in the firing head assembly 18a and into the open end 20a of the tubing connector 20. Such increased well pressure will be immediately transmitted through the tubing extension 17 and the rupture disc 15 will be ruptured, with such well pressure now being conveyed through the well pressure tube 13 and into the flow passageway 9e of the piston connector 9. As the well pressure increases, such pressure will be defined across the piston end 8d of the free piston 8 and the shear pin 11a will be sheared. The free piston 8 now will move into abutting engagement with the lower end of the piston 6. As the free piston 8 moves upwardly, the release groove 8c will move upwardly until it is parallel with the locking dogs 10 within the running groove 10a. The locking dogs 10 now will contract and be received within the release groove 8c. Now, the lower housing member 4b no longer is secured against longitudinal movement relative to the upper housing member 4a, and telescopic contracting movement between such housing members 4a, 4b is initiated. As such movement is initiated, the piston 6, free piston 8, and lower housing member 4b will telescopically contract relative to the upper housing member 4a. Such telescoping contraction will increase the pressure within the first chamber 5 until such time as the bias within spring 7a holding the valve head 7b on the seat 7c is overcome and the head 7b will be biased away from the seat 7c to permit the fluid within the first chamber 5 to be transmitted through the pressure relief valve 7, and into the flow passageway 6b of the piston 6, thence through the passageway 8b of the free piston 8 and into the lower second chamber 5a. Thus, the telescopic contraction is dampened by the metering of the fluid within the first chamber 5 through the pressure relief valve 7 and into the second chamber 5a.

When the telescopic action between the upper housing member 4a and lower housing member 4b has been effected, the lower housing member 4b will be prevented from telescopically expanding relative to the upper housing member 4a by means of the interengagement of the teeth 54a of the slip 54 onto the smooth exterior of the lower housing member 4b as the lock dog members 55 urge the slip 54 downwardly and into contracting position relative to the profile 52 on the lock nose 51.

Subsequent to the telescopic action, it will be appreciated that the lowermost end of the gun 21 is within the end 23 of the section of the production string PS and the seal assembly SA now may be stabbed into the upwardly extending connector CN and into the bore of the sump packer SP. Alternatively, prior to such stabbing action of the seal assembly SA, acidizing or fracturing of the well can be established in a known manner.

The first packer assembly will now be described in detail.

Now with particular reference to FIGS. 1, 4A, 4B, 5, 6, 7, 8A, 8B, 9, 10, 11, 12, 13, 14A and 14B, prior to running the well packer RP into the well on a workstring WS also carrying a permanent packer PP, the casing C has been placed into the well and cemented therein. The casing C, which has a smaller diameter liner section C-1 has been placed into the well and cemented therein. The casing liner C-1 will have perforations therethrough subsequent to the firing of a perforating gun.

The retrievable well packer RP is adapted to be anchored to the casing liner C-1 against movement in both an upward and downward direction, and to packed-off condition against the wall of a well casing to prevent leakage of fluid thereby. The lowermost portion of the tool is a set-down type of well packer, the upper portion D of the tool being constituted as an anchor to prevent upward movement of the apparatus in the well casing C-1.

The well packer RP is lowered in the well casing on the tubular workstring WS extending to the top of the well W, and through which fluent substances under pressure, such as cement slurry, acid, and the like, can be pumped, flowing through the central passage of the tool for discharge from its lower portion.

The well packer RP includes a central main body or mandrel 210 having a passage 211 therethrough that may be of relatively large diameter. The upper portion of this body is threadably secured to a top body sub 2202 by means of threads 2223. The mandrel 210 extends downwardly through the entire length of the well packer RP and has a lower threaded pin 215 for threaded attachment to a lower section of tubing or a lower tool F.

The upper portion D of the tool includes an anchor body 219 surrounding the mandrel 210, and which may be laterally spaced therefrom to provide an annular space 220 therebetween. This annular space 220 extends upwardly through a housing 221 for a control valve and a balance sleeve 222, the lower end of the housing 221 being threadably attached to the upper end of the anchor body 219.

The anchor body has a plurality of circumferentially spaced cylindrical bores 223 therethrough, each containing a piston gripping element 224 slidably radially therein. Each cylindrical bore 223 is open to the interior of the anchor body 219 and also to the exterior thereof. The piston gripping elements 224 have external wickers or teeth 225 that may face in an upward direction to anchor the well packer A to the well casing C-1 against upward movement therewithin.

As shown, a plurality of cylinders 223 and gripping elements 224 are provided in longitudinal alignment with one another, there being sets of such longitudinally aligned gripping elements 224 disposed around the circumference of the anchor body 219.

The anchor body has external grooves 226 on opposite sides of aligned cylinders in each set, these grooves merging into companion grooves 227 formed in the outer portions of the longitudinally aligned gripping elements 224. Disposed in the body and gripping element grooves are retainer members and spring seats 228 in the form of bars suitably secured to the anchor body, as by use of screws 229. Each bar retains the piston gripping elements 224 properly oriented with their wickers or teeth 225 facing in an upward direction. Each bar also serves as the outer spring seat for a helical compression spring 230 disposed in and bearing against the socket portion 231 of each piston gripping element 224, tending to urge each piston gripping element inwardly to its fullest extent, but yieldably permitting its inward and outward radial movement.

The piston gripping elements 224 are expanded outwardly whenever fluid pressure differential, sufficient to overcome the compressive force of the springs 230, is present interiorly of the body 219. In the present case, such fluid pressure is derived from the exterior of the tool below the anchor portion D of the apparatus, which pressure can pass through the annular space 220 between the body or mandrel 210 of the tool and the anchor body 219 to each of the cylinders 223. The fluid pressure differential for expanding the gripping elements is actually derived from a location in the well casing C-1 below the set down type of well packer portion of the tool, passing from such location into the annular space 220 through a path described hereinbelow. Fluid pressure in the cylinders 223 urges each piston 224 outwardly, leakage of fluid along each piston being prevented by a suitable piston ring or side seal ring 233 in the piston slidably sealing against the wall of its companion cylinder 223.

The inner mandrel or body 210 is shiftable longitudinally with respect to the anchor body 219 and the housing 221 secured thereto to open and close the annular passage 220. Thus, the mandrel carries the valve head 234 threadably attached to the top or body sub 212, which has a suitable peripheral seal ring 235 thereon, the head and seal ring being adapted to move downwardly within a cylindrical seat 236 formed in the valve head portion 237 of the housing 221. When the mandrel 210 is shifted downwardly relative to the anchor body 219 and the housing 221, its valve head 234 and seal ring 235 are moved within the cylindrical seat 236 such that the elastomer seat 235 is snugly secured against the uppermost end 236 of the valve head portion 237, closing the upper portion of the annular passage 220 and enabling the pressure below the tool and tending to elevate the mandrel 210 to be counter balanced, so as to prevent inadvertent opening of the valve device. The annular balancing sleeve 222 is disposed in an annular cylinder portion 238 of the housing 221. This sleeve or piston 222 includes a head 239 initially occupying an upward position adjacent to a cylinder head 240, the piston head 239 being slidable along the wall of the cylinder 238. Leakage of fluid between the piston and cylinder is prevented by a suitable piston ring 241 carried by the piston and slidably sealing against the wall of the cylinder 238. The piston has a skirt 242 depending from its head 239, which is slidable along and within the upper portion of the anchor body 219, leakage of fluid therebetween being prevented by suitable side seal 243 mounted in the anchor body and slidably sealing against the outer periphery of the skirt 242. The piston device 222 has an internal diameter substantially greater than the external diameter of the body or mandrel 210, so as not to obstruct the annular passage 220 between the body 210 of the tool and the housing 221 and anchor body 219 surrounding the body 210.

Integral with the balancing member 222 are upwardly extending arms 244 formed by providing circumferentially spaced longitudinal slots 245 in an upper portion of the balance member, these arms terminating in upper fingers or heads 246 initially disposed in an internal groove 247 in the housing 221, the heads 246 tending to spring inwardly and initially engaging the periphery of the tool body. When the mandrel 210 is moved downwardly within the anchor body 219 and housing 221, to dispose the valve head 234 and seal 235 within the valve seat 236, and thereby close the valve portion of the device, a peripheral groove 248 in the mandrel 210 below the valve head 234 is located opposite the fingers or heads 246, such fingers or heads then springing inwardly within such groove 248 and out of the internal circumferential groove 247 in the valve head. Any pressure in the closed annular passage 220 will now act in a downward direction on the piston head 239, such downward force being transmitted through the fingers 246 to the lower side 249 of the mandrel groove 248, thereby tending to urge the body or mandrel 210 in a downward direction. The lower side 249 of the mandrel groove and the lower inner portions 250 of the fingers or heads are inclined in an inward and upward direction, so that upward movement of the mandrel 210 relative to the fingers or heads will cam the ladder outwardly when they are disposed opposite the internal housing groove 247. When the fingers or heads are disposed in the mandrel groove 248, they are out of the housing groove 247 and are free to move into the lower smaller diameter portion 251 of the housing 221, the balance device 222 then being free from the housing 221 and capable of exerting a downward force on the body or mandrel 210.

The fluid pressure within the well packer RP when in its set condition tends to act in an upward direction over the cross-sectional area of the body 210 and its valve head 234, designated by the letter S, tending to shift the mandrel 210 in an upward direction with respect to the valve seat 236, which would effect opening of the valve. Such upward movement is counter balanced, in the present instance, by making the annular area R of the balance piston 239 substantially equal to the area S. The fluid pressure within the tool is acting in a downward direction on the piston over the area R and such downward force is transmitted through the latch fingers or heads 246 to the mandrel 210. Thus, substantially equal and opposite forces are being exerted by the fluid pressure on the body or mandrel 210, precluding its inadvertent shifting under the action of fluid pressure to a valve opening condition. If desired, the area R can be made slightly greater than the area S so that the fluid pressure is actually tending to maintain the body or mandrel 210 in a downward direction to insure against inadvertent opening of the valve device and the annular passage 220.

The valve device can readily be shifted to an open condition merely by elevating the tubular string WS, which will shift the body or mandrel 210 upwardly with respect to the anchor body 219 and the housing 221. There is very little, if any, resistance by fluid pressure to such upward movement of the mandrel, in view of the balancing action of the fluid pressure acting in an upward direction over the area S and in a downward direction over the area R. Accordingly, the mandrel 210 and the balance sleeve 222 latched thereto are moved upwardly until the fingers 246 are disposed opposite the circumferential groove 247 in the housing 221, whereupon the lower shoulder or side 249 of the mandrel groove can cam the fingers outwardly into the housing groove 247, the fingers thereby being free to the mandrel groove 248 to allow the mandrel 210 to move upwardly to its fullest extent, free from restraint by the fingers 246.

The upper anchor portion D of the apparatus is secured to the downwardly acting set down type of well packer RP. The packer RP includes a normally retracted packing device 255 surrounding the tubular body or mandrel 210, which includes an inner support sleeve 256 threadably attached to the lower end of the anchor body 219 and spaced laterally from the body to provide a continuation to the annular passage 220 through which fluid can pass. Surrounding the support sleeve is a packing structure 257, such as a rubber or rubber-like elastomeric packing sleeve, which is normally retracted. The upper end of the packing structure 257 is adapted to engage the lower end of the anchor body 219, which serves as an upper abutment. It also engages an upper gauge ring 258 threaded on the lower end of the anchor body 219, and serving as an outer extension of the upper abutment. The lower end of the packing sleeve 257 is engagable with a lower abutment 259 slidable on the support sleeve 256 and threadably connected to an expander sleeve portion or sleeve extension 260, which is integral with a lower expander 261 of generally frusto-conical shape adapted to coact with a plurality of circumferentially spaced lower slips 262 for anchoring the apparatus in the well casing liner C-1.

When the packing structure 257 is in relaxed position, the lower abutment 259 may engage an external lower flange 263 of the support sleeve 256. The support sleeve and the expander sleeve portion 260 may be non-rotatably secured to one another, while permitting their relative telescopic movement, by attaching a key 264 to the flange portion of the upper sleeve which is slidable in a longitudinal key way or slot 265 in the interior of the expander sleeve 260.

Fluid can pass through the annular space 266 surrounding the apparatus and around the expander 261, flowing inwardly through a plurality of circumferentially spaced ports or openings 267 in the expander sleeve portion 260 to its interior and then flowing upwardly through the annular passage 220, discharging through the valve seat 236 and into the annulus 266 around the body 210 and the tubular workstring WS. Downward movement of the tubular workstring WS and body 210 relative to the members surrounding the body will, as has been described above, place the valve head 234 in engagement in the valve seat 236 to close the annular passage 220 around the body.

A connector sleeve 269 is slidably mounted on the exterior of the body 210, its upper portion extending within the expander 261 and terminating in an upper stop or flange 270 that projects outwardly and is adapted to engage the upper end 271 of the expander. The lower end of the connector sleeve 269 may rest upon the upper end of a setting pin 2317.

Surrounding the connector sleeve 269 is a slip sleeve 273 slidable thereon and having a plurality of longitudinally extending circumferentially spaced grooves 274 in which the slips 262 are laterally movable. These slips each include a lower drag portion 275 adapted to frictionally engage the inner wall of the well casing liner C-1, and are urged outwardly thereagainst by one or a plurality of compression springs 276 engaging the basis of the grooves 274 and the drag portion 275 of the slips. The slips 262 include upper anchor portions 277 having downwardly facing wickers or teeth 278 adapted to engage and embed themselves in the wall of the well casing liner C-1, to prevent downward movement of the slips therealong when expanded outwardly by the expander 261. The expander 261 has a downward and inwardly inclined tapered surface 279 adapted to coact with a companion inner tapered surface 280 on the anchor portion 277 of the slips.

Outward expansion of the slip 262 under the influence of the springs 276 is limited by a retainer ring 281 encompassing the central portions of the slips and received within external grooves 282 therewithin. Outward movement is also limited by engagement of lower terminals 283 of the slips, below the drag portions 275, with an upper rim 284 of the orienting pin housing 2302 surrounding the body 210 of the tool. The orienting pin housing 2302 and the slip sleeve 273 are secured together by means of the orienting pin 2301 so that they move as a unit.

The slips 262 are positioned above a setting means 2300 which has the orienting pin 2301 secured by threads 2302 into a rotation bearing 2306, the orienting pin 2301 being received within a pin bore 2303 of the bearing 2306.

The orienting pin housing 2302 is secured by means of threads 2304 to a drag block retainer 2305 therebelow. The drag block retainer 2305 receives a rotation sleeve 2307 containing the setting pin 2317 protruding inwardly of the drag block retainer 2305 within a pin bore 2308 of the sleeve 2307. The drag block retainer 2305 also houses a drag block 2400 frictionally engaging the inner wall of the casing liner C-1 at the lowermost end of the tool for resistance of longitudinal movement relative to the liner C-1 and urged outwardly by means of a plurality of spring members 2401 within a receptacle 2402. The lowermost end of the drag block retainer 2305 is secured by threads 2404 to a lower retainer 2403.

The connector sleeve 269 carries around its exterior a snap ring 2224 which is initially carried on a shoulder 2225 of the orienting pin housing 2302, such that the connector sleeve 269 and orienting pin housing 2302 are interengaged, during run-in.

The setting means 2300 has its orienting pin 2301 in orienting position 2310 on orienting slot 2309. The pin 2301 is in the orienting position 2310 during run-in of the well packer A and moves from the position 2310 to the setting position 2317 within the orienting slot 2309.

While the orienting pin 2301 always remains within the orienting slot 2309, such is not the case with the setting pin 2317. The setting pin 2317 is initially carried within the running slot 2311 at the running position 2312 on the upper end 2313 of the running slot 2311. When it is desired to set the well packer RP within the liner C-1, the workstring WS is picked up such that the slots 2309 and 2311 move up relative to the housing 2302 and its interrelated parts. Accordingly, the orienting pin 2301 will move from the orienting position 2310 to the setting position 2317 in the orienting slot 2309 and the setting pin 2317 will move from the upper end 2313 of the running slot 2311 to the slot curvature portion 2314 bridging the lowermost end of the running slot 2311 with the lowermost end of the orienting slot 2309 to cause relative rotation between the mandrel 210 and the orienting pin housing 2302 to place the setting pin 2317 in the setting position 2316 of the orienting slot 2309. Now, the pins 2301 and 2317 are aligned such that there is no further resistance to longitudinal movement of the tubular workstring WS relative to the orienting pin housing 2302 and its interrelated parts because of the movement of the setting pin 2317 off of the upper end 2313 of the running slot 2311. Now, set down weight may be applied to the workstring WS to move the member 260 to engage the bevel 279 relative to the companion profile 280 on the slip assembly 277 to drive the wicker 278 into the inner wall of the liner section of casing C-1 to anchor the well packer apparatus RP to the wall of the liner C-1.

The slips 262 are prevented from having substantial longitudinal movement relative to the slip sleeve 273 by engagement of the lower ends 294 of the slips with the upper end of the orienting pin housing 2302 by means of the engagement of the snap ring 2224 on the shoulder 2225 of the orienting pin housing 2302 and also by engagement of the retainer ring 281 with an upper external flange 295 of the slip sleeve 273. The slips 262 are also held away from the exPander or cone 261 by means of a retraction maintenance means 2200 at the uppermost end of the tool. The retraction maintenance means 2200 component parts operate in concert with the orientation, initially, of the snap ring 2224 relative to the orienting pin housing 2302 such that, until the well packer RP is transversely positioned interiorly of the liner C-1 below the enlarged diameter casing C-2, the well packer A cannot be manipulated by longitudinal movement of the workstring WS to the set position.

The retraction maintenance means 2200, being the uppermost end of the well packer A, is secured at the threads 2201 to the workstring WS, or other component tool associatedly carried by the workstring WS, the threads 2201 being on a top sub member 2202 which, in turn, is secured by means of threads 2223 to the member 210.

The top sub 2202 carries a drag block 2203 having an outer hardened surface 2204 for smooth contact with the inner wall of the enlarged casing conduit C-2. The drag block 2203 is spring biased outwardly by means of a plurality of spring members 2208 housed within bores 2207 with biasing ends contacting a profile 2209 on the top sub 2202 and the other end biasingly contacting the drag block housing 2206. The housing 2206 is secured at its uppermost end by means of threads 2210 to an upper retainer 2205 secured therearound and at its lower end by means of threads 2212 to a lower retainer 2211. A lock extension 2213 extends downwardly of the housing 2206 having a lock shoulder 2214 thereon normally secured within an abutment 2217 of a key member 2216 carried at the uppermost end of a housing lock sleeve 2215. The housing lock sleeve 2215 has its lowermost end 2218 abutting inwardly for coengagement with a top extension 2220 of a housing sleeve 2219 secured at threads 2221 and set screw 2222 to the valve head portion 237.

As long as the well packer RP is within the enlarged diameter regular casing C-2, the springs 2208 will bias the housing 2206 of the drag block 2203 outwardly such that the outer surface 2204 always engages the smooth interior wall of the casing C-2. This interengagement will keep the lock shoulder 2214 of the lock extension 2213 into secured engagement with the housing lock sleeve 2215 by means of interengagement with the abutment 2217 of the body 2216. Therefore, when the retraction maintenance means 2200 is in such position, and the snap ring 2224 is in abutment with the shoulder 2225 on the orienting pin housing 2302, there can be no relative longitudinal movement between the member 210 and the packing assembly 255 and the cones 261 relative to the slips 277. However, when the device comes into engagement with the smaller diameter liner C-1, the springs 2208 will be compressed, permitting the drag block 2203 to contract. Such contraction will disengage the lock shoulder 2214 relative to the abutment 2217 such that the housing lock sleeve 2215, housing sleeve 2219, valve head portion 237, and all interrelated parts may be manipulated longitudinally relative to the mandrel 210 as the apparatus is reciprocated in response to relative longitudinal movement of the workstring WS to move the cones 261 into engagement with the slips 277 and to activate movement of the seal assembly 255 into sealing engagement with the interior wall of the casing liner C-1.

When the slip sleeve 273 is moved downwardly, its upper flange 295 engages the retainer ring 281, which engages the lower sides of the slip grooves 282 to pull the slip 262 downwardly in the well casing. When the slip sleeve 273 and the orienting pin housing 2302 are moved upwardly, the upper end of the control member engages the lower ends 294 of the slips and shifts them upwardly along the wall of the well casing C-1.

The slips themselves are of the rocker type, in that the anchor portions 277 are removed from engagement with the wall of the well casing C-1 when the springs 276 are permitted to force the drag member 275 into full contact with the wall of the well casing C-1. However, when the expander 261 moves downwardly within and behind the anchor portion 277 of the slips, the latter will rock outwardly about the upper parts of the drag portion 275 as a fulcrum on the casing, to shift the teeth 278 outwardly against the well casing and embed them therewithin. The packer body or mandrel 210 moves downwardly with respect to the parts that surround it in order to engage the valve head 234 with its companion valve seat 236, to expand the packing structure 257 against the wall of the well casing C-1, and to engage the expander 261 with the anchor portion 277 of the slips and expand the latter outwardly into anchoring engagement with the wall of the well casing C-1. The ability of the body 210 of the tool to move in the manner just described is dependent upon the control mechanism provided between the slip mounting portions 273, 2302 of the apparatus and the body 210 of the control tool 210, including the setting means 2300.

OPERATION OF THE FIRST PACKER MEANS

When the well packer RP is disclosed within the enlarged casing C-2, the retraction maintenance means 2200 will be in "locked" position, such that the expansion of the packer 255 and the anchoring of the slips 277 cannot occur by longitudinal manipulation of the workstring WS at any time while the tool is in any conduit portion within the well W having an internal diameter larger than that for the casing liner C-1. In such position, the lock shoulder 2214 is in locked abutting relationship to the abutment 2217 of the key 2216 and the snap ring 2224 is secured within the shoulder 2225 of the orienting pin housing 2302. The orienting pin 2301 is in the orienting position 2310 of the orienting slot 2309 and the setting pin 2317 is shouldered on the upper end 2313 of the running slot 2311 at the running position 2312. When the packer RP is moved by longitudinal movement of the workstring WS from the large diameter casing C-2 to the liner C-1 having a smaller internal diameter, the springs 2208 are compressed and the drag block 2203 contracts within the top sub 2202 freeing the lock extension 2213 from interengagement with the housing lock sleeve 2215, and the lock shoulder 2214 becomes disengaged from the abutment 2217. Now, the well packer RP will be responsive to longitudinal manipulation of the workstring WS to set the well packer RP.

At the desired location within the well and in the liner C-1, when it is desired to set the well packer RP, the workstring will be picked up to align the setting pin 2317 with the orienting pin 231 and move the setting pin 2317 from within the running slot 2311 and into the orienting slot 2309. Accordingly, as the workstring WS is longitudinally manipulated and picked up, the mandrel 210 will move upwardly relative to the orienting pin housing 2302 and the setting pin 2317 will travel relatively down the running slot 2311 to the slot curvature 2314. It will be appreciated that the drag block 2400 resists longitudinal movement of the orienting pin housing 2302 relative to the mandrel 210, but rotation of the pins 2317, 2301 is permitted because they rotate within their respective rotation housings 2307, 2306. When the setting pin 2317 is at the bottom of the slot curvature 2314, further resistance to upward movement of the workstring WS will be detected at the top of the well, and the workstring WS may be set down, causing the mandrel 210 to move downwardly relative to the orienting pin housing 2302 and shift the setting pin 2317 from the running slot 2311 into the orienting slot 2309 to the setting position 2316.

As downward movement of the body 210 occurs, the valve head 234 and seal ring 235 move downwardly into the cylindrical valve seat 236 to close the annular passage 220, the downward movement of the body 210 then moving the housing 221 and anchor body 219 and support sleeve 256 therewith, the packing structure 257 and the lower abutment 259 also being moved downwardly for the purpose of shifting the expander sleeve portion 260 and the expander 261 downwardly, accompanied by the connector sleeve 269. The expander 261 moves downward toward the slip 262, which are prevented from moving downwardly by engagement of their drag portion 275 with the wall of the well casing-C-1. The connector sleeve 269 moves downwardly with the expander 261 and the body 210 and within the slip structure, the snap ring 2224 camming the control pin 2317 out of the way and allowing the snap ring to move pass the control pin 2317 which will now slide upon the periphery of the connector sleeve. The downward movement of the body 210 and the parts surrounding it with the exception of the slip structure surrounding the connector sleeve 269, will now continue until the expander 261 moves within and behind the anchor portions 277 of the slips, shifting the latter outwardly into engagement with the wall of the well casing C-1. When this occurs, the expander 261 cannot move downwardly any further. Accordingly, the continued downward movement of the body 210 of the tool causes the anchor portion of the upper element 219, 258 to move toward the lower abutment 259, which is prevented from moving downwardly by being connected to the expander 261, compressing or shortening the packing sleeve 257 and expanding it outwardly into sealing engagement with the wall of the well casing liner C-1.

As described above, upon downward movement of the body 210 within the anchor portion D and housing 221 of the tool, the peripheral groove 248 of the body is disposed opposite the latch fingers or heads 246, the latter snapping into such groove and out of the housing groove 247 whereupon the fingers or heads are adapted to bear against the lower shoulder 249 on the mandrel and then being disposed below the internal housing groove 247 and adapted to slide downwardly along the housing portion 251, at least to a small extent. The balance device 222 is now in condition to offset any pressure differentials in the apparatus, or therebelow, that would otherwise tend to shift the body or mandrel 210 upwardly and inadvertently open the valve and the annular passage 220 between the body 210 of the tool and the anchor portion D and the packing device 255.

A suitable operation can now be performed with the set packer RP. Thus, fluid under pressure is pumped down the tubular string WS and through the body or mandrel 210. Such fluid under pressure is also imposed on the fluid in the well bore below the set packing structure 255, passing through the port 267 and into the annulus 220 between the mandrel 210 and the anchor portion D and housing 221 connected to the anchor body. The fluid pressure acts on the gripping members 224 and urges them outwardly into gripping engagement with the wall of the well casing. In the event the apparatus is subjected to high pressure differentials, the anchoring action of the gripping members 224 against the well casing will prevent upward pumping or movement of the packer apparatus RP in the well casing C-1. At the same time, as has been noted above, such fluid pressure in the annulus 220 between the body or mandrel 210 and the housing 221 acts in a downward direction on the piston 239, the downward force being opposed through the latch heads 246 on the mandrel shoulder 249 urging the body or mandrel 210 in a downward direction and offsetting the tendency of the fluid pressure acting over the area S of the mandrel and tending to shift it in an upward direction.

After the operation in the well bore has been completed, the first packer RP can be released from the well casing C-1 and removed therefrom, if desired. If the fluid pressure has been relieved, release will occur simply as the result of elevating the workstring WS and the body or mandrel 210 in the casing C-1. The expander 261 will move upwardly away from the slip 277 and the orienting pin 2301 and setting pin 2317 will travel downwardly within the orienting slot 2309. The setting pin 2317 will contact the lower end of the curvature 2315 and will be pivoted into the running slot 2311 and will be positioned on the upper end 2313 of the slot 2311 in the running position 2312, with the orienting pin 2301 replaced into the orienting position 2310 in the orienting slot 2309. Because the of the hydraulic counter-balance feature, the fluid pressure is substantially balanced on the body or mandrel 210, so that the latter can be shifted upwardly with exertion of comparatively little force on the workstring WS. At first, the body moves upwardly to carry the valve head 234 upwardly within the cylindrical valve seat 236, and also to carry the fingers or heads 246 upwardly with it until the latter or disposed opposite release groove 247 in the housing 221, whereupon the body or mandrel 210 will cam the latch heads or heads 246 outwardly free from the groove 248. The mandrel 210 can then shift upwardly to the extent required, the valve head and its seal moving out of the valve seat 236 in order to open the annular passage 220 around the mandrel 210 thereby enabling the fluid pressure to be equalized internally and externally of the apparatus. Following equalizing of the fluid pressure, the spring 230 shifts the piston gripping elements 234 to their retracted position free from engagement with the wall of the well casing liner C-1.

During the initial phase of upward movement of the mandrel 210, the upper end 272 of the mandrel 210 will carry the setting pin 2317 on the upper end of 2313 such that the setting pin 2317 will contact the lowermost end of the connector sleeve 269 to move it upwardly such that the upper end 270 thereof engages the lower end of the support sleeve 256, whereupon the support sleeve and the anchor portion D connected thereto are shifted upwardly with the body 210, to move the upper abutment constituted by the anchor body 219 and gauge ring 258 away from the lower abutment 259 which will permit the packing sleeve 257 to retract to its initial position. The support sleeve 256 moves upwardly with the body 210 and the connector sleeve 269 until its lower flange 263 engages the lower abutment 259, which will then elevate the expander sleeve portion 260 and the expander 261 from the anchor portion 271 of the slip 262, allowing the spring 276 to rock the drag portion 275 of the slips back into full surface contact with the wall of the well casing C-1 and pivot the anchor portion 277 inwardly from engagement with the wall of the well casing C-1. The expander 261 can move upwardly of the slips until the orienting pin housing 2302 engages the abutment on the member F by contact of the retainer 2403 thereon. The parts are now in the position they occupy during elevation of the first packer means RP in the well casing C-1. During such elevating movement through fluid in the well casing C-1, the resistance of such fluid cannot inadvertently expand the piston gripping elements 224 and the packing structure 257 against the wall of the well casing C-1 since the fluid force is disposed internally of the gripping elements 224 as well as externally thereof and it is also prevented from acting on and moving the upper abutment or anchor body 219 relatively downwardly toward the lower abutment 259 which would effect a shortening of the packing structure 257 and its outward expansion.

It will also be appreciated that when the well packer RP passes from within the liner casing C-2 to within the enlarged casing section C-1 as a result of further longitudinal pulling of the workstring WS, the retracting maintenance means 2200 will be activated and the compressive bias within the springs 2208 will be released to cause the drag block 2203 to move outwardly of the to sub 2202 such that the lock extension 2213 becomes engaged with the housing lock sleeve 2215 and the lock shoulder 2214 comes into abutment contact with the abutment 2217 of the key 2216. Now, there can be no inadvertent setting of the well packer RP as it is retrieved to the top of the well.

While the drawings show a threaded connection between casing members C-2, C-1, such is for illustration only, since those skilled in the art will appreciate that such connection is achieved by means of a liner hanger device, the construction details of which extend far beyond the scope of this invention. The hanger is not part of the present invention.

The second packer assembly, which is settable by application of hydraulic pressure through the workstring will now be described in detail.

Now referring to FIGS. 1, 15A, 15B, 16A, 16B, 17A, 17B, 18A, 18B, and 19 through 22, the second or production packer PP is secured by threads 314 at its uppermost end to a section of tubular conduit or workstring WS. The threads 314 are placed interiorly around an upper extension of an upper body member 315 which is secured to a key housing 312 by means of threads 313. A key lock member 317 is carried interiorly of the key housing 312 and above a key 316 keyed into a splineway **316*a* therefore to prevent relative rotational movement between the upper body member 315 and an upper housing member 311 extending from the splineways 316*a***.

The upper housing member 311 is matingly engaged to a central housing member 310 extending therebelow by a slot and key configuration 320, 319. By means of such key and slot assembly 320, 319, the upper housing member 311 and the central housing member 310 are interengaged one to another and cannot rotate relative to each other. The upper housing member 311 and central housing member 310 also are secured one to another by means of a collet 318 having a collet head **318*a* extending adjacent the upper body member 315 and on a shoulder 315*a*. The collet 318 has a series of serrated finger elements extending interiorly of the central housing member 310 with threads 318*b* thereon being matingly secured to threads 310*a* on the central housing member 310**.

An inwardly facing smooth locking shoulder **318*c* on the collet 318 is initially urged toward the threads 310*a* by means of a locking surface 321*b* of a locking sleeve 321 which is urged into engagement relative to the collet 318 by contact of its upper face 321*a* with the lower shoulder 315*b* on the upper body member 315 by means of the upward urging of a piston member 323, discussed below. The locking sleeve 321 is held in position against the collet 318 by means of the inner face of the shoulder 318*c* and the lock surface 321*b* and by the positioning of the locking sleeve 321 along the smooth outer wall 315*c* of the upper body member 315**.

Below the locking sleeve 321 and defined between the exterior of the upper body member 315 and the interior of the central housing member 310 is a annulus pressure chamber 322 acting on the upper face of a sliding piston 323 having an O-ring seal 325 for smooth interengagement with the inner wall of the central housing member 310 and a similar O-ring 324 carried around the interior of the piston 323 for smooth sealing contact with the outer wall of the upper body member 315. The piston 323 separates the annulus pressure chamber 322 thereabove from the upper tubing pressure chamber 326 defined therebelow.

The upper tubing pressure chamber 326 is defined at its uppermost end by means of the seal elements 324, 325 on the piston 323 and at its lowermost end by an O-ring element 330 on a piston head 329 carried on a tubing extension 392 and secured thereto by means of threads 331, the extension 392 being secured at its uppermost end by means of threads 393 to a seal housing **315*d*. The uppermost end of the seal housing 315*d* is secured at threads 327 and set screw 328 to the upper body member 315**.

The seal housing **315*d* has a flow passage 315*e* communicating with the interior of the upper body member 315 for transmission of hydraulic pressure within the tubular conduit and workstring WS for maintaining the locking sleeve 321 in its uppermost position for engaging the collet 318 in engaged position with the upper housing member 311. Fluid is permitted to pass interiorly of the seal housing 315 through the passage 315*e* and through a ported elastomer 315*f* which filters sand and other particulate debris and provides a diaphragm. Fluid then may pass into the upper tubing pressure chamber 326 through the upper passage 315*e*′ and also into the lower tubing pressure chamber 326*a* below the seal housing 315*d* through the lower passage 315*e*″**.

The piston head 329 is secured by threads 332 to a tubular extension 333 carried lowerly through the production packer PP and extending to the perforating gun and other apparatuses.

The seal assembly 391 is carried exteriorly around the central housing member 310 and is comprised of a series of elastomeric elements and metallic or other backup rings. The seal assembly 391 is of a known construction and may take a variety of forms well known to those skilled in the art. The uppermost end of the seal assembly 391 contacts the lowermost face of an upper gauge ring 334 secured at threads 335 to the central housing member 310. A similar lower gauge ring 336 is not secured to the central housing member 310, but, rather, is secured by means of threads 337 to the secondary piston sleeve 338 which is carried interiorly of the lower gauge ring 336, a body lock ring 340 therebelow and a piston cylinder 352 secured by means of threads to the body lock ring 340.

The secondary piston sleeve 338 has a series of one way ratcheting teeth 339 disposed exteriorly thereround and facing companion ratcheting teeth **340*a* on the body lock ring 340. When the apparatus is shifted to activate the seal assembly into expanded position within the well to sealing securement relative to the inner wall of the casing C, the secondary piston sleeve 338 will move longitudinally relative to the body lock ring 340 causing the one way ratcheting teeth 339, 340*a* to ratchet relative to one another and secure the seal assembly 391 in expanded position and will prevent retraction of the seal assembly 391 and the slips 368, 369**, until the apparatus is released, as described below.

During the setting procedure, described below, the lower end **340*b* of the body lock ring 340 will move relatively toward the top end 341*a* of a piston head 341** carried at the lowermost end of the secondary piston sleeve 338.

The piston head 341 has an effective operating area thereacross defined by the O-rings 342, 343 thereon.

The secondary piston sleeve 338 is secured against longitudinal movement relative to the piston cylinders 352, 358 through a plurality of locking dogs 345 housed initially in a bore 341*b* in the sleeve 338 below the piston head 341 and extending inwardly within a lock shoulder 344 on the central housing member 310.

Below the secondary piston sleeve 338 and contacting the lower end 346 of the sleeve 338 is a primary piston sleeve 350 having an upper end 347 initially abutting the lower end 346 of the sleeve 338. The sleeve 350 is held in place initially against relative longitudinal movement with respect to the housing of the apparatus by means of the abuttment contact between the ends 347, 346 and also by means of a shear ring 351 extending within a shear ring groove 351*a* on the primary piston sleeve 350. The shear ring 351 has a portion secured against the lower end of the piston cylinder 352, the piston cylinder 352, in turn, carrying within a groove 353 a split ring 354 carried lowerly of a shoulder 355 on a ring retainer 356 secured at threads 357 to the lower piston cylinder 358.

The primary piston sleeve 350 has an effective area thereacross defined by an O-ring 349 carried on the lowermost end of the sleeve 350 and O-ring 364 carried therebelow and on the lower piston cylinder 358.

Positioned between the rings 349, 364 and on the central housing member 310 is a setting pressure port 359 which receives application of tubing pressure applied across the piston area defined by the rings 349, 364 during the setting procedure, described below.

The central housing member 310 also receives a split ring 360 within a groove 361, the split ring 360 extending upon a shoulder 362 on the lower piston cylinder 358. The ring 360 resists effective relative longitudinal movement between the housing member 310 and the cylinders 352, 358 until the actuating procedure is initiated.

The housing 310 also carries below the split ring 360 a shear ring 365 extending outwardly and housed between the lowermost end of the lower piston cylinder 358 and the upper cone member 366. During the setting procedure, the shear ring 365 will be the first shear member to separate during actuation.

The lowermost end of the central housing member 310 is secured at threads 379 to a key housing member 383 which has a groove 383*a* therein for receipt of a non rotation key member 380 which, in turn, is splined at 381 to a lower housing member 382 exteriorly thereof. The key housing 383 has a lower shoulder 383*b* which will prevent further upward longitudinal movement of a sleeve 385 by interface of the shoulder 383*b* with the top 385*b* of the sleeve 385 during the shifting procedure to unset the apparatus, described below.

A collet 384 extends downwardly of the key housing 383 and has a head 384*b* protruding toward the lower housing member 382 for initial securement on a lock surface 382*a* of the lower housing member 382 by means of the surface 384*a* on the collet head 384*b*. The collet head 384*b* is shear pinned at 386 to the sleeve 385 cylindrically disposed interiorly around the collet head 384*b*. During disengagement and release of the apparatus, an auxiliary conduit, such as continuous coiled tubing, or a smaller workstring, or the like, is disposed within the workstring WS and has a release mechanism having a prong extending thereon for engagement onto the latch surface 385*a* of the sleeve 385. Upon pulling of the prong, the sleeve 385 will be urged upwardly, shearing the pin 386, and moving the sleeve 385 until interface of the shoulders 383*b* and 384*a* to permit the collet head 384 to flex inwardly, thus releasing the cylinders 358, 352, and ring 340 from the central housing member 310 and its companion parts to move the upper slip expander 368 to contract the slips 368, 369 and retract the seal assembly 391 for retrieval of the apparatus to the top of the well W.

The lower piston cylinder 358 is secured at threads 363 to an upper cone member 366 having a lowerly extending profiled ramp 367 for interface with a companion ramp on the upper slips 368. An upper slip retainer 368*a* is disposed around the exterior of the cone 366 for securement of the slips 368 at their uppermost end, the slips 368 and 369 also being secured in place by means of a retainer 371 urged outwardly by means of a spring member 370 to permit the slips to "rock" into place during the anchoring procedure. The lower slips 369 are urged outwardly during the setting operation by means of the ramp 373 on the lower cone 372, a lower slip retainer 374 being disposed around the exterior of the lower cone 372.

During the setting procedure, the lower end 376 of the lower cone 372 will be moved toward the upper face 377*a* of a seal piston member 377 housed between the central housing member 310 and the lower housing member 382. The lower housing member 382 is secured by means of threads 375 to the lower cone 372 with an annulus port 378 being provided above the seal piston 377. The seal piston 377 prevents fluid communication between the lower housing member 382 and the central housing member 310 by means of the seals 377*b*, 377*c* carried thereon. The lower housing member 382 is secured by means of threads 387 to a lower housing section 390 having, in turn, threads 390*a* for securement to a tubular extension thereon. A lower gauge ring 389 is carried exteriorly around the lower housing section 390 and is secured thereto by means of threads 388.

OPERATION OF THE SECOND PACKER MEANS

After the production packer PP has been positioned within the well W at its desired location, a plug (not shown) is run into the well on wireline or auxiliary conduit and implaced therein at a position below the production packer PP. Thereafter, pressure is applied through the interior of the workstring WS and the interior of the production packer PP and is introduced between the effective piston area defined by the rings 364, 349 through the setting pressure port 359 until the shear strength of the shear ring 365 is overcome, whereby the shear ring 365 will part and permit the cylinders 352 and 358 to move downwardly relative to the stabilized central housing member 310. The setting ramp 367 of the upper cone 366 will slide under the upper slips 368 and will cause the lower slips 369 to ride on the ramp 373 of the lower cone 372, thus urging the slips 368, 369 outwardly into anchoring and securing condition to resist movement of the production packer PP relative to the casing, the slips 368, 369 being dual acting, thus resisting movement of the production packer PP against longitudinal movement in either direction relative to the casing C.

Upon setting of the slip 368, 369, the cylinders 352, 358 will become stabilized relative to the central housing 310 and the pressure through the setting pressure port 359 will now be exerted on the primary piston sleeve 350 and, in turn, the piston head 341 to shear the shear ring 351. It will be appreciated that during the setting of the slip assembly, the piston cylinder 352 is moved downwardly relative to the piston head 341 permitting the locking dogs 345 to expand outwardly of the bore 341*b* releasing the central housing member 310 from the secondary piston sleeve 338 and the primary piston sleeve 350. As the primary piston sleeve 350 moves upwardly in tandem with the secondary piston sleeve 338, the setting pressure is transferred through the piston sleeves 338 and 350 to the lower gauge ring 336 which moves against the lower end of the seal assembly 391 to expand it into sealing expanded position along the smooth interior wall of the casing C, as the central housing 310 is stabilized against any longitudinal movement. During upward movement of the secondary piston sleeve 338, the one way ratcheting teeth 339 come into engagement with the companion ratcheting teeth 340*a* of the body lock ring 340 to effect a ratcheting movement such that the setting force defined through the pistons 350, 338 is locked into the seal assembly 391 and downward movement of the sleeve 338 is thereby prevented.

When it is desired to unseat the packer PP for any purpose after the setting procedure, an auxiliary wireline or other tool carried into the well on a line or auxiliary conduit, such as remedial coiled tubing can be extended into the packer PP until a prong (not shown) is secured against the surface 385*a* of the sleeve 385 and an upward pull is applied to said wireline or auxiliary tool to shear the pin 386 and shift the sleeve 385 upwardly until the surface 384*a* abuts the shoulder 383*b* of the key housing 383. The collet head 384*b* will flex inwardly, thus releasing the central housing member 310 and its associated parts from the seal assembly 391, slip 368, 369, etc. and the central housing member 310 and key housing 383 will be pulled upwardly until the upper face 377*a* of the seal piston 377 abuts the lower end 376 of the lower cone 372. During movement of the central housing member 310 upwardly, the upper cone 366 has been expanded away from the slips 368, causing the slips 368, 369 to retract and the seal assembly 391 to become unsealed from its position on the wall of the casing C. The packer PP in this expanded condition may be retrieved to the top of the well, along with other components secured thereto, directly or indirectly at threads 390*a*.

In the event that it is desired, for any reason, to disconnect the production packer PP from the workstring WS at any time, either prior to or after setting of the production packer PP, the differential between annulus pressure in the annulus pressure chamber 322 and the tubing pressure in the tubing pressure chamber 326 is varied to move the piston 323 away from the locking sleeve 321. Now, the collet 318, which is biased inwardly, will flex inwardly, separating the threads 310*a*, 318*b*, and the upper body member 315 and its associate parts, including the tubing extension 392, may be separated from the central housing member 310, with the keys 319 separating relative to the slots 320. The upper housing member 311 thus also will be removed from the central housing member 310 and carried to the top of the well with the upper body member 315.

Now with particular reference to FIGS. 19 through 22, the locator mandrel LM is carried into the well W on the workstring WS at the lowermost end of the apparatus. The locator mandrel LM is carried on the work string WS at the lowermost end of the entire apparatus and has an exterior sealing surface LM-1 for selective sealing engagement with seal receptacle SR positioned in the well below a production zone Z. Subsequent to the firing of the perforating gun and retraction of the gun, the work string or production string may be longitudinally manipulated to sealingly position the locator mandrel LM within the seal receptacle SR. Now, when the locator mandrel LM is in such sealing engagement with the seal receptacle SR, the production zone Z will not be in fluid communication with the interior of the production or work string until the sliding sleeve SS is opened to communicate the production or work string with the zone Z through opened ports in the sleeve SS. The mandrel has an exterior sealing surface LM-1 for selective sealing engagement with a seal receptacle SR positioned in the well below the production zone Z whereby subsequent to the firing of the perforating gun and retraction of the gun by the means for telescopically retracting the gun, the workstring WS may be longitudinally manipulated to sealingly position the locator mandrel LM relative to said seal receptacle assembly.

Subsequent to the firing of the perforating gun and retraction of the gun, as described above, the workstring WS is manipulated to release the first packer means RP from set position. The workstring WS is manipulated longitudinally downwardly such that the locator seal assembly is placed within the interior of the seal receptacle assembly. Now, hydraulic pressure is applied through the workstring WS to hydraulically set the second packer means. After setting of the second packer means PP, the workstring WS is retrieved to the top of the well with the first packer means, the perforating gun, and the gun retractor means. A sliding sleeve SS is positioned on the exterior of the apparatus and is the valve means which prevents fluid communication between the exterior and the interior of that portion of the apparatus which is retained in the well, as described above, and is selectively movable, such as by insertion through the apparatus of a workstring, wireline, coiled tubing, or other device, having affixed thereon a probe, or a prong to manipulate the valve means by affixation to a sliding sleeve or the like to open a port within the valve means, or other device, to permit fluid communication between the exterior and the interior of the apparatus, such as when it is desired to permit production fluids to pass from the production zone to the interior of the apparatus and thence to the top of the well.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. An apparatus for completion of a horizontal section of a subterranean well, comprising:

(1) a first packer assembly settable in said well only by longitudinal manipulation of a tubular work string, said first packer assembly comprising:

(a) an outer housing;

(b) a seal assembly and anchoring means carried by said housing in initial retracted position and movable to expanded position for engagement along the inner wall of a tubular conduit disposed within said well;

(c) a longitudinally extending control mandrel telescopically movable within said housing, at least one of said housing and said control mandrel operably extending from said work string;

(d) orienting and setting pins carried on one of said housing and said control mandrel;

(e) orienting slot means having a first length and running slot means having a second length shorter than said first length, each of the slot means being defined on the other of said housing and said control mandrel for receipt of said orienting and setting pins, respectively; and (f) means for manipulating said housing relative to said mandrel to a first position to orient said pins and said slot means whereby said orienting pins are within said orienting slot means and said setting pins are within said running slot means to place said seal assembly and said anchoring means in retracted position, and to a second position whereby said orienting and setting pins are within said orienting slot means to place said seal assembly and said anchoring means in expanded position;

(2) a second packer assembly settable by application of hydraulic pressure through said work string, said second packer comprising:

(a) a tubular housing;

(b) a seal assembly disposed around said housing and carried in said well in initially retracted position and activatable into expanded position within said well to sealing securement relative to the inner wall of said tubular conduit;

(c) anchoring means for securing said second packer in position within said tubular conduit and activatable to securing condition to resist movement of said second packer relative to said tubular conduit in at least one direction;

(d) first and second cylindrical members of said tubular housing movable in a first direction to actuate one of said seal assembly and said anchoring means into engagement with said tubular conduit; and (e) primary and secondary piston means carried within said cylindrical members and tandemly arranged for movement in a second direction to activate the other of said seal assembly and said anchoring means and responsive to pressure introduced through said work string for said actuation, each of said piston means being selectively secured against longitudinal movement relative to said housing and selectively secured against longitudinal movement relative to each other, said primary piston being released relative to said housing upon application of hydraulic pressure across one of said piston means prior to release of said secondary piston relative to said housing whereby upon release of said piston means relative to said housing, said piston means and said cylinder members are movable to actuate said seal assembly to expanded position and said anchoring means to securing condition;

(3) a perforating gun carriable into said well on and in communication with said work string;

(4) means for telescopically retracting said perforating gun, comprising:

(a) a cylindrical housing carriable into said well on said work string;

(b) a first chamber within said housing and containing a body of fluid;

(c) telescoping piston means selectively releasably locked relative to said housing;

(d) a second chamber in selective fluid flow communication with said first chamber;

(e) means securing the perforating gun relative to said piston means within said well;

(f) means for communicating well pressure to said piston means upon firing of said perforating gun; and (g) means for selectively transferring said body of fluid from said first chamber to said second chamber, whereby during such transferring, said gun is telescopically retracted relative to said housing; and (5) a locator mandrel carriable in said well on said workstring at the lowermost end of said apparatus, said mandrel having an exterior sealing surface thereon for selective sealing engagement with a seal receptacle assembly positioned in said well below a production zone, whereby subsequent to firing of said perforating gun and retraction of said gun by said means for telescopically retracting said gun, said workstring may be longitudinally manipulated to sealingly position said locator mandrel relative to said seal receptacle assembly.

2. A method for completing a horizontal section of a subterranean well, comprising the steps of:

assembling at the top of the well on a tubular work string, an apparatus comprising:

(1) a first packer assembly settable in said well only by longitudinal manipulation of a tubular work string, said first packer assembly comprising:

(a) an outer housing;

(b) a seal assembly and anchoring means carried by said housing in initial retracted position and movable to expanded position for engagement along the inner wall of a tubular conduit disposed within said well;

(c) a longitudinally extending control mandrel telescopically movable within said housing, at least one of said housing and said control mandrel operably extending from said work string;

(d) orienting and setting pins carried on one of said housing and said control mandrel;

(e) orienting slot means having a first length and running slot means having a second length shorter than said first length, each of the slot means being defined on the other of said housing and said control mandrel for receipt of said orienting and setting pins, respectively; and (f) means for manipulating said housing relative to said mandrel to a first position to orient said pins and said slot means whereby said orienting pins are within said orienting slot means and said setting pins are within said running slot means to place said seal assembly and said anchoring means in retracted position, and to a second position whereby said orienting and setting pins are within said orienting slot means to place said seal assembly and said anchoring means in expanded position;

(2) a second packer assembly settable by application of hydraulic pressure through said work string, said second packer comprising:
(a) a tubular housing;
(b) a seal assembly disposed around said housing and carried in said well in initially retracted position and activatable into expanded position within said well to sealing securement relative to the inner wall of said tubular conduit;
(c) anchoring means for securing said second packer in position within said tubular conduit and activatable to securing condition to resist movement of said second packer relative to said tubular conduit in at least one direction;
(d) first and second cylindrical members of said tubular housing movable in a first direction to actuate one of said seal assembly and said anchoring means into engagement with said tubular conduit; and
(e) primary and secondary piston means carried within said cylindrical members and tandemly arranged for movement in a second direction to activate the other of said seal assembly and said anchoring means and responsive to pressure introduced through said work string for said actuation, each of said piston means being selectively secured against longitudinal movement relative to said housing and selectively secured against longitudinal movement relative to each other, said primary piston being released relative to said housing prior to release of said secondary piston relative to said housing whereby upon release of said piston means relative to said housing upon application of hydraulic pressure across one of said piston means, said piston means and said cylinder members are movable to actuate said seal assembly to expanded position and said anchoring means to securing condition;
(3) a perforating gun carriable into said well on and in communication with said work string;
(4) means for telescopically retracting said perforating gun, comprising:
(a) a cylindrical housing carriable into said well on said work string;
(b) a first chamber within said housing and containing a body of fluid;
(c) telescoping piston means selectively releasably locked relative to said housing;
(d) a second chamber in selective fluid flow communication with said first chamber;
(e) means extending from with said piston means for carrying said perforating gun within said well;
(f) means for communicating well pressure to said piston means upon firing of said perforating gun; and
(g) means for transferring said body of fluid from said first chamber to said second chamber, whereby during such transferring, said gun is telescopically retracted relative to said housing; and
(5) a locator mandrel carriable in said well on said workstring at the lowermost end of said apparatus, said mandrel having an exterior sealing surface thereon for selective sealing engagement with a seal receptacle assembly positioned in said well below a production zone, whereby subsequent to firing of said perforating gun and retraction of said gun by said means for telescopically retracting said gun, said workstring may be longitudinally manipulated to sealingly position said locator mandrel relative to said seal receptacle assembly;

running said apparatus within said well on said tubular work string and positioning each of said packer assemblies above a production zone whereby said perforating gun is approximately adjacent said production zone and said apparatus for telescopically retracting said perforating gun is disposed across said horizontal section immediately thereabove;

longitudinally manipulating said work string in a first direction to move said setting pins from said running slot means to said orienting slot means;

longitudinally manipulating said work string in the opposite direction to move said seal assembly and said anchoring means from retracted position to expanded position along the inner wall of the tubular conduit;

initiating firing of the perforating gun;

actuating said means for telescopically retracting said gun;

introducing a treating fluid into said workstring and flowing said treating fluid through said apparatus for contact with said production zone;

longitudinally manipulating said workstring to sealingly position said locator mandrel relative to said seal receptacle assembly;

setting said second packer assembly; and withdrawing said first packer assembly, said gun and said means for telescopically retracting said gun with said workstring from said well.

3. Apparatus of claim 1 further comprising valve means disposed on said apparatus below said second packer for selective communication between the exterior and interior of said apparatus.

4. The method of claim 2 further comprising the step of:

manipulating valve means disposed on said apparatus below said second packer to establish fluid communication between the exterior and interior of said apparatus.

5. Apparatus for completion of a subterranean well, comprising:
(1) a first packer assembly settable in said well only by longitudinal manipulation of a tubular workstring;
(2) a second packer assembly settable by application of hydraulic pressure through said workstring;
(3) a perforating gun carriable into said well on and in communication with said workstring;
(4) means for telescopically retracting said perforating gun; and
(5) a locator mandrel carriable in said well on said workstring at the lowermost end of said apparatus, said mandrel having an exterior sealing surface thereon for selective sealing engagement with a seal receptacle assembly positioned in said well below a production zone whereby subsequent to firing of said perforating gun and retraction of said gun by said means for telescopically retracting said gun, said workstring may be longitudinally manipulated to sealingly position said locator mandrel relative to said seal receptacle assembly.

6. Apparatus for completion of a horizontal section of a subterranean well, comprising:

(1) a first packer assembly settable in said well only by longitudinal manipulation of a tubular workstring;

(2) a second packer assembly settable by application by hydraulic pressure through said workstring;

(3) a perforating gun carriable into said well on and in communication with said workstring;

(4) means for telescopically retracting said perforating gun;

(5) a locator mandrel carriable in said well on said workstring at the lowermost end of said apparatus, said mandrel having an exterior sealing surface thereon for selective sealing engagement with a seal receptacle assembly positioned in said well below said production zone whereby subsequent to firing of said perforating gun and retraction of said gun by said means for telescopically retracting said zone, said workstring may be longitudinally manipulated to sealingly position said locator mandrel relative to said seal receptacle assembly; and (6) valve means disposed on said apparatus below said second packer for selective communication between the exterior and interior of said apparatus.

7. A method for completing a horizontal section of a subterranean well, comprising the steps of:

assembling at the top of the well on a tubular work string, an apparatus comprising:

(a) a first packer assembly settable in said well only by longitudinal manipulation of a tubular workstring;

(b) a second packer assembly settable by application by hydraulic pressure through said workstring;

(c) a perforating gun carriable into said well on and in communication with said workstring;

(d) means for telescopically retracting said perforating gun;

(e) a locator mandrel carriable in said well on said workstring at the lowermost end of said apparatus, said mandrel having an exterior sealing surface thereon for selective sealing engagement with a seal receptacle assembly positioned in said well below a production zone whereby subsequent to firing of said perforating gun and retraction of said gun by said means for telescopically retracting said zone, said workstring may be longitudinally manipulated to sealingly position said locator mandrel relative to said seal receptacle assembly; and (f) valve means disposed on said apparatus below said second packer for selective communication between the exterior and interior of said apparatus;

setting said first packer means;

initiating firing of the perforating gun;

actuating said means for telescopically retracting said gun;

introducing a treating fluid into said workstring and flowing said treating fluid through said apparatus for contact with said production zone;

longitudinally manipulating said workstring to sealingly position said locator mandrel relative to said seal receptacle assembly;

setting said second packer assembly; and withdrawing said first packer assembly, said gun and said means for telescopically retracting said gun with said workstring from said well.

* * * * *